US007469433B2

(12) United States Patent
Ruehl et al.

(10) Patent No.: US 7,469,433 B2
(45) Date of Patent: Dec. 30, 2008

(54) PATIENT SUPPORT WITH VARIABLE LENGTH ACTUATOR AND RELEASE MECHANISM FOR LOWERING A SECTIONAL SUPPORT SURFACE

(75) Inventors: John W. Ruehl, Shelbyville, IN (US); Jeffrey R. Welling, Batesville, IN (US); Brian Wiggins, Burlington, KY (US); Matthew W. Weismiller, Batesville, IN (US); Sandy Richards, Pershing, IN (US); Brent Goodwin, Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 87 days.

(21) Appl. No.: 11/057,791

(22) Filed: Feb. 14, 2005

(65) Prior Publication Data

US 2005/0144723 A1 Jul. 7, 2005

Related U.S. Application Data

(60) Continuation of application No. 10/704,168, filed on Nov. 7, 2003, now Pat. No. 6,854,145, which is a division of application No. 09/872,594, filed on Jun. 1, 2001, now Pat. No. 6,654,974.

(60) Provisional application No. 60/209,053, filed on Jun. 2, 2000, provisional application No. 60/219,221, filed on Jul. 18, 2000.

(51) Int. Cl.
*A61G 7/015* (2006.01)
*A61G 7/018* (2006.01)

(52) U.S. Cl. ..... 5/617

(58) Field of Classification Search ..... 5/613, 5/614, 615, 616, 617, 618, 619, 610, 607, 5/608, 609, 611, 600, 601; 378/209; 600/415
See application file for complete search history.

(56) References Cited

U.S. PATENT DOCUMENTS

| | | | |
|---|---|---|---|
| 388,995 | A | 9/1888 | Moxham |
| 964,170 | A | 7/1910 | Leonard |
| 1,469,841 | A | 10/1923 | Lazar |
| 1,469,928 | A | 10/1923 | Lazar |
| 1,835,021 | A | 12/1931 | Decker |
| 1,930,993 | A | 10/1933 | Blodgett |
| 2,021,107 | A | 11/1935 | Logie |
| 2,067,891 | A | 1/1937 | Comper |

(Continued)

FOREIGN PATENT DOCUMENTS

DE 29 11 743 10/1979

(Continued)

OTHER PUBLICATIONS

Hill-Rom, Inc., "The Affinity™ Bed from Hill-Rom"; copyright 1992; 12 pages.

(Continued)

*Primary Examiner*—M. Safavi
(74) *Attorney, Agent, or Firm*—Barnes & Thornburg LLP

(57) ABSTRACT

A patient support including a frame and a patient support portion supported by the frame. The patient support includes a release mechanism configured to move a portion of the patient support from a raised position to a lowered position.

23 Claims, 21 Drawing Sheets

U.S. PATENT DOCUMENTS

| | | | | | |
|---|---|---|---|---|---|
| 2,120,732 | A | | 6/1938 | Comper et al. | |
| 2,257,491 | A | | 9/1941 | Armstrong | |
| 2,275,973 | A | | 3/1942 | Marchbanks | |
| 2,290,191 | A | | 7/1942 | Karlson | |
| 2,306,031 | A | | 12/1942 | Anderson et al. | |
| 2,381,633 | A | | 8/1945 | Young | |
| 2,470,524 | A | | 5/1949 | Schudder | |
| 2,523,076 | A | * | 9/1950 | Sweetland | 5/611 |
| 2,536,534 | A | * | 1/1951 | Carter | 5/616 |
| 2,605,151 | A | | 7/1952 | Shampaine | |
| 2,617,117 | A | * | 11/1952 | Putterbaugh | 5/616 |
| 2,640,998 | A | | 6/1953 | Myre | |
| 2,658,211 | A | | 11/1953 | Bendersky | |
| 2,696,207 | A | * | 12/1954 | Bushnell | 5/610 |
| 2,757,058 | A | | 7/1956 | Brosesel | |
| 2,754,142 | A | | 8/1956 | Baker, Jr. | |
| 2,766,463 | A | | 10/1956 | Bendersky | |
| 2,832,655 | A | | 4/1958 | Adolphson | |
| 2,872,259 | A | | 2/1959 | Thorpe | |
| 3,041,120 | A | | 6/1962 | Burzlaff et al. | |
| 3,041,121 | A | | 6/1962 | Comper | |
| 3,041,122 | A | | 6/1962 | Weidkgenannt et al. | |
| 3,100,129 | A | | 8/1963 | Adolphson | |
| 3,167,789 | A | | 2/1965 | Wicks | |
| 3,220,022 | A | | 11/1965 | Nelson | |
| 3,226,105 | A | | 12/1965 | Weickgenannt et al. | |
| 3,227,440 | A | | 1/1966 | Scott | |
| 3,231,905 | A | | 2/1966 | Brochu | |
| 3,281,141 | A | | 10/1966 | Smiley et al. | |
| 3,318,596 | A | | 5/1967 | Herzog | |
| 3,334,951 | A | | 8/1967 | Douglass, Jr. et al. | |
| 3,411,766 | A | | 11/1968 | Lanigan | |
| 3,414,913 | A | * | 12/1968 | Stanley et al. | 5/616 |
| 3,486,747 | A | | 12/1969 | Cardoso | |
| 3,492,679 | A | | 2/1970 | Drew | |
| 3,587,592 | A | | 6/1971 | Price et al. | |
| 3,599,963 | A | | 8/1971 | Grover | |
| 3,686,696 | A | | 8/1972 | Lanigan | |
| 3,710,404 | A | * | 1/1973 | Peterson | 5/616 |
| 3,733,481 | A | | 5/1973 | Kuyt | |
| 3,764,795 | A | | 10/1973 | Austin, Jr. | |
| 3,813,091 | A | | 5/1974 | Metzger | |
| 3,817,512 | A | | 6/1974 | Torrey | |
| 3,821,821 | A | * | 7/1974 | Burst et al. | 5/616 |
| 3,845,945 | A | | 11/1974 | Lawley et al. | |
| 3,851,870 | A | | 12/1974 | Cook | |
| 3,868,103 | A | | 2/1975 | Pageot et al. | |
| 3,997,926 | A | | 12/1976 | England | |
| 4,025,972 | A | | 5/1977 | Adams et al. | |
| 4,034,972 | A | | 7/1977 | Peterson | |
| 4,057,240 | A | | 11/1977 | Damico et al. | |
| 4,097,939 | A | | 7/1978 | Peck et al. | |
| 4,139,917 | A | | 2/1979 | Fenwick | |
| 4,148,472 | A | | 4/1979 | Rais et al. | |
| 4,174,547 | A | * | 11/1979 | Wetzler | 5/616 |
| 4,178,625 | A | | 12/1979 | Schudel | |
| 4,225,126 | A | | 9/1980 | Lee | |
| 4,225,127 | A | | 9/1980 | Strutton | |
| 4,227,269 | A | | 10/1980 | Johnston | |
| 4,233,649 | A | | 11/1980 | Scheer et al. | |
| 4,247,091 | A | | 1/1981 | Glowacki et al. | |
| 4,323,060 | A | | 4/1982 | Pecheux | |
| 4,333,638 | A | | 6/1982 | Gillotti | |
| 4,336,965 | A | | 6/1982 | Lipp | |
| 4,346,487 | A | | 8/1982 | Holdt et al. | |
| 4,356,578 | A | | 11/1982 | Clark | |
| 4,395,071 | A | | 7/1983 | Laird | |
| 4,411,035 | A | | 10/1983 | Fenwick | |
| 4,426,071 | A | | 1/1984 | Klevstad | |
| 4,457,502 | A | | 7/1984 | Beach | |
| 4,472,845 | A | | 9/1984 | Chivetta et al. | |
| 4,472,846 | A | * | 9/1984 | Volk et al. | 5/611 |
| 4,552,348 | A | | 11/1985 | Forssmann et al. | |
| 4,564,164 | A | | 1/1986 | Allen et al. | |
| 4,577,730 | A | | 3/1986 | Porter | |
| 4,615,058 | A | | 10/1986 | Feldt | |
| 4,632,349 | A | | 12/1986 | Anstey | |
| 4,639,954 | A | | 2/1987 | Speed | |
| 4,646,211 | A | | 2/1987 | Gallant et al. | |
| 4,682,376 | A | | 7/1987 | Feldt | |
| 4,688,780 | A | | 8/1987 | Hanz | |
| 4,698,837 | A | | 10/1987 | Van Steenburg | |
| 4,724,555 | A | | 2/1988 | Poehner et al. | |
| 4,751,754 | A | | 6/1988 | Bailey et al. | |
| 4,805,249 | A | | 2/1989 | Usman et al. | |
| 4,807,618 | A | | 2/1989 | Auchinleck et al. | |
| 4,821,350 | A | | 4/1989 | Feldt | |
| 4,860,394 | A | | 8/1989 | Benessis et al. | |
| 4,882,566 | A | | 11/1989 | Koerber, Sr. et al. | |
| 4,882,797 | A | | 11/1989 | Failor et al. | |
| 4,886,258 | A | | 12/1989 | Scott | |
| 4,894,876 | A | | 1/1990 | Fenwick | |
| 4,898,491 | A | | 2/1990 | Van Steenburg | |
| 4,940,218 | A | | 7/1990 | Akcelrod | |
| 4,968,013 | A | | 11/1990 | Kirk | |
| 4,993,762 | A | | 2/1991 | Rogers et al. | |
| 5,039,167 | A | | 8/1991 | Sweet | |
| 5,060,327 | A | | 10/1991 | Celestina et al. | |
| 5,081,729 | A | | 1/1992 | Menady | |
| 5,103,384 | A | | 4/1992 | Drohan | |
| 5,104,363 | A | | 4/1992 | Shi | |
| 5,109,554 | A | | 5/1992 | Borders et al. | |
| 5,116,008 | A | | 5/1992 | Allen | |
| 5,129,116 | A | | 7/1992 | Borders et al. | |
| 5,129,117 | A | | 7/1992 | Celestina et al. | |
| 5,134,737 | A | | 8/1992 | Wyman | |
| 5,134,739 | A | | 8/1992 | Gaffe et al. | |
| 5,148,562 | A | | 9/1992 | Borders | |
| 5,157,787 | A | * | 10/1992 | Donnellan et al. | 5/610 |
| 5,157,800 | A | | 10/1992 | Borders | |
| 5,161,274 | A | | 11/1992 | Hayes et al. | |
| 5,197,156 | A | | 3/1993 | Stryker et al. | |
| 5,201,087 | A | | 4/1993 | Wickham | |
| 5,205,004 | A | | 4/1993 | Hayes et al. | |
| D336,577 | S | | 6/1993 | Celestina et al. | |
| D336,578 | S | | 6/1993 | Celestina et al. | |
| 5,214,812 | A | | 6/1993 | Bartow | |
| 5,226,187 | A | | 7/1993 | Borders et al. | |
| 5,329,657 | A | | 7/1994 | Bartley et al. | |
| 5,331,698 | A | | 7/1994 | Newkirk et al. | |
| 5,362,302 | A | | 11/1994 | Jensen | |
| 5,375,276 | A | | 12/1994 | Nelson et al. | |
| 5,377,373 | A | | 1/1995 | Shirari | |
| 5,398,357 | A | | 3/1995 | Foster | |
| 5,423,097 | A | | 6/1995 | Brule et al. | |
| 5,444,880 | A | * | 8/1995 | Weismiller et al. | 5/618 |
| 5,454,126 | A | | 10/1995 | Foster et al. | |
| 5,460,346 | A | | 10/1995 | Hirsch | |
| 5,466,249 | A | | 11/1995 | de Putter | |
| 5,472,412 | A | | 12/1995 | Knoth | |
| 5,479,666 | A | | 1/1996 | Foster et al. | |
| 5,481,770 | A | | 1/1996 | Ahlsten | |
| 5,502,862 | A | | 4/1996 | Vosbikian | |
| 5,509,159 | A | * | 4/1996 | Du-Bois | 5/611 |
| 5,522,098 | A | | 6/1996 | Podgorschek | |
| 5,555,582 | A | | 9/1996 | Jerideau | |
| 5,560,577 | A | | 10/1996 | Keselman | |
| 5,577,279 | A | | 11/1996 | Foster et al. | |
| 5,628,078 | A | | 5/1997 | Pennington et al. | |
| 5,636,394 | A | | 6/1997 | Bartley | |
| 5,636,899 | A | | 6/1997 | Schiff | |
| 5,645,079 | A | | 7/1997 | Zahiri | |
| 5,661,859 | A | | 9/1997 | Schaefer | |
| 5,692,255 | A | | 12/1997 | Canfieldr | |

| | | | |
|---|---|---|---|
| 5,708,997 | A | 1/1998 | Foster et al. |
| 5,735,593 | A | 4/1998 | Gallant et al. |
| 5,740,571 | A | 4/1998 | Tyra |
| 5,740,572 | A | 4/1998 | Hannant |
| 5,774,914 | A | 7/1998 | Johnson et al. |
| 5,778,467 | A | 7/1998 | Scott et al. |
| 5,791,761 | A | 8/1998 | Bryant et al. |
| 5,802,641 | A | 9/1998 | Van Steenburg |
| 5,806,114 | A | 9/1998 | Morgan et al. |
| 5,862,549 | A | 1/1999 | Morton et al. |
| 5,878,748 | A | 3/1999 | Garth et al. |
| 5,913,774 | A | 6/1999 | Feddema |
| 5,926,878 | A | 7/1999 | Morton et al. |
| 5,933,888 | A | 8/1999 | Foster et al. |
| 5,941,175 | A | 8/1999 | Bannister |
| 5,961,085 | A | 10/1999 | Navarro et al. |
| 6,058,534 | A | 5/2000 | Navarro et al. |
| 6,112,345 | A | 9/2000 | Foster et al. |
| 6,141,806 | A | 11/2000 | Bobey et al. |
| 6,174,068 | B1 | 1/2001 | Ambach et al. |
| 6,202,230 | B1 | 3/2001 | Borders |
| 6,226,816 | B1 | 5/2001 | Webster et al. |
| 6,226,821 | B1 | 5/2001 | Heimbrock et al. |
| 6,230,345 | B1 | 5/2001 | Borrero et al. |
| 6,282,738 | B1 | 9/2001 | Heimbrock et al. |
| 6,409,131 | B1 | 6/2002 | Bentley et al. |
| 6,412,126 | B2 | 7/2002 | Heimbrock et al. |
| 6,487,735 | B1 | 12/2002 | Jacques, II et al. |
| 6,546,577 | B1 | 4/2003 | Chinn |
| 2001/0011394 | A1 | 8/2001 | Heimbrock et al. |
| 2002/0083527 | A1 | 7/2002 | Ruehl et al. |
| 2002/0092096 | A1 | 7/2002 | Heimbrock et al. |

FOREIGN PATENT DOCUMENTS

| | | |
|---|---|---|
| DE | 35 00 313 | 7/1985 |
| DE | 297 02 889 | 5/1997 |
| DE | 196 05 549 | 8/1997 |
| DE | 298 00 015 | 5/1998 |
| EP | 0 150 254 | 8/1985 |
| EP | 0 376 066 | 8/1993 |
| EP | 0 681 799 | 11/1995 |
| EP | 0 604 240 | 10/1996 |
| EP | 0 839 508 | 5/1998 |
| EP | 0 845 254 | 6/1998 |
| FR | 636085 | 3/1928 |
| FR | 1456058 | 10/1966 |
| FR | 1518724 | 12/1966 |
| FR | 1566571 | 5/1969 |
| FR | 2061319 | 5/1971 |
| FR | 2666013 | 2/1992 |
| GB | 497662 | 12/1938 |
| GB | 1389344 | 4/1975 |
| GB | 2041737 | 9/1980 |
| GB | 2225228 | 5/1990 |
| JP | 55-50357 | 12/1980 |
| JP | 58-81032 | 5/1981 |
| JP | 56-109663 | 8/1981 |
| JP | 60-85749 | 5/1985 |
| JP | 60-145138 | 7/1985 |
| JP | 60-195018 | 12/1985 |
| JP | 61-119257 | 6/1986 |
| JP | 61-168351 | 7/1986 |
| JP | 61-44019 | 10/1986 |
| JP | 61-50626 | 11/1986 |
| JP | 2-147120 | 6/1990 |
| JP | 2-297366 | 12/1990 |
| JP | 2-297367 | 12/1990 |
| JP | 2-297368 | 12/1990 |
| JP | 3-004808 | 1/1991 |
| JP | 3-004809 | 1/1991 |
| JP | 5-031145 | 2/1993 |
| JP | 6-012755 | 4/1994 |
| JP | 61-22577 | 5/1994 |
| JP | 6-506850 | 8/1994 |
| JP | 7-112012 | 5/1995 |
| SU | 381350 | 5/1973 |
| WO | WO 92/18082 | 10/1992 |
| WO | WO 92/18083 | 10/1992 |
| WO | WO 93/09750 | 5/1993 |
| WO | WO 99/23991 | 5/1999 |
| WO | WO 00/07537 | 2/2000 |

OTHER PUBLICATIONS

Stryker Adel, "2100EC Childbearing Bed, Ultimate Convenience and Confort"; Jan. 1994; 6 pages.

Stryker Adel, "500XL Childbearing Bed"; copyright May 1995; 2 pages.

Stryker Adel, "2110 Childbearing Bed, Service Manual"; copyright 1988; pp. 1-18.

Stryker Adel, "500XL Childbearing Bed, Service Manual"; copyright 1986; pp. 1-16.

LINAK Actuators LA34; http://www.linak.com/Products/?id3=1; Aug. 23, 2006 pp. 1-8.

* cited by examiner

PATIENT SUPPORT WITH VARIABLE LENGTH ACTUATOR AND RELEASE MECHANISM FOR LOWERING A SECTIONAL SUPPORT SURFACE

CROSS REFERENCE TO RELATED APPLICATIONS

This application is a continuation of U.S. patent application Ser. No. 10,704,168, filed Nov. 7, 2003 now U.S. Pat. No. 6,853,145, which is a divisional of U.S. patent application Ser. No. 09/872,594, filed Jun. 1, 2001 now U.S. Pat. No. 6,654,974, which claims the benefit of U.S. Provisional Application Ser. No. 60/209,053, filed Jun. 2, 2000, and U.S. Provisional Application Ser. No. 60/219,221, filed Jul. 18, 2000, the disclosures of which are expressly incorporated by reference herein.

BACKGROUND AND SUMMARY OF THE INVENTION

The present invention relates to patient supports such as hospital beds, carts, chairs, and stretchers. More particularly, the present invention relates to a light assembly releasably coupled to a patient support.

Hospital beds and other patient supports are often provided with laterally spaced adjustable foot supports positioned proximate a seat section. The seat section and the foot supports are configured to define a central opening therebetween. An example of such a patient support is disclosed in detail in U.S. Pat. No. 6,226,821, which is assigned to the assignee of the present invention and is expressly incorporated by reference herein.

According to an illustrative embodiment of the present invention, a patient support comprises a patient support surface facing upwardly toward a patient, and a storage surface positioned in spaced relation to the patient support surface. At least one retainer is coupled to the storage surface. A light source is configured to be moved between a use position and a storage position, wherein the light source is configured to provide light for a caregiver when in the use position, and the light source is releasably supported by the retainer when in the storage position. Illustratively, the light source is configured to direct light toward a patient supported on the patient support surface when in the use position, while the light source is configured to be positioned in spaced relation to the patient support surface when in the storage position. A coupler is configured to releasably support the light source when in the use position.

Illustratively, an arm is coupled to the light source, and the retainer includes a resilient clip configured to releasably couple to the arm.

Further illustratively, the patient support includes a head portion and a foot portion spaced apart from the head portion, and the patient support surface and the storage surface are defined by the foot portion. The foot portion illustratively includes a pair of laterally spaced apart foot supports defining an access opening therebetween, and the coupler is coupled to at least one of the foot supports such that the light source is supported by at least one of the foot supports when in the use position.

Illustratively, the foot portion includes a removable foot section, and the at least one retainer is supported by the removable foot section.

According to a further illustrative embodiment of the present invention, a bed comprises a frame, and a head portion supported by the frame. A foot portion is supported by the frame and is spaced apart from the head portion. A seat portion is supported by the frame and is positioned intermediate the head portion and the foot portion. The foot portion includes a foot section removably supported by the frame, the foot section including an underside and a storage area positioned on the underside. A light assembly is configured to be removably coupled to the foot section within the storage area.

Illustratively, the light assembly includes a light source and an arm coupled to the light source. The foot section includes a retainer configured to removably couple the arm to the foot section.

Further illustratively, a coupler is supported by the foot portion, and the arm of the light assembly is configured to be releasably coupled to the coupler. The foot portion illustratively includes a pair of laterally spaced foot supports configured for movement relative to the frame, and the coupler is coupled to at least one of the foot supports.

According to another illustrative embodiment of the present invention, a bed comprises a frame and a patient support portion supported by the frame. The patient support portion includes an upwardly facing patient support surface and a downwardly facing storage surface. A retainer is coupled to the storage surface, and a light assembly is configured to be releasably coupled to the retainer.

Illustratively, the patient support portion includes a section removably coupled to the frame.

Further illustratively, the light assembly includes a light source and an arm coupled to the light source. The retainer is configured to removably couple the arm to the patient support portion.

Additional features of the disclosure will become apart to those skilled in the art upon consideration of the following detailed description when taken in conjunction with the accompanying drawings.

BRIEF DESCRIPTION OF THE DRAWINGS

The detailed description particularly refers to the accompanying figures in which.

DETAILED DESCRIPTION OF THE DRAWINGS

Figure 1:
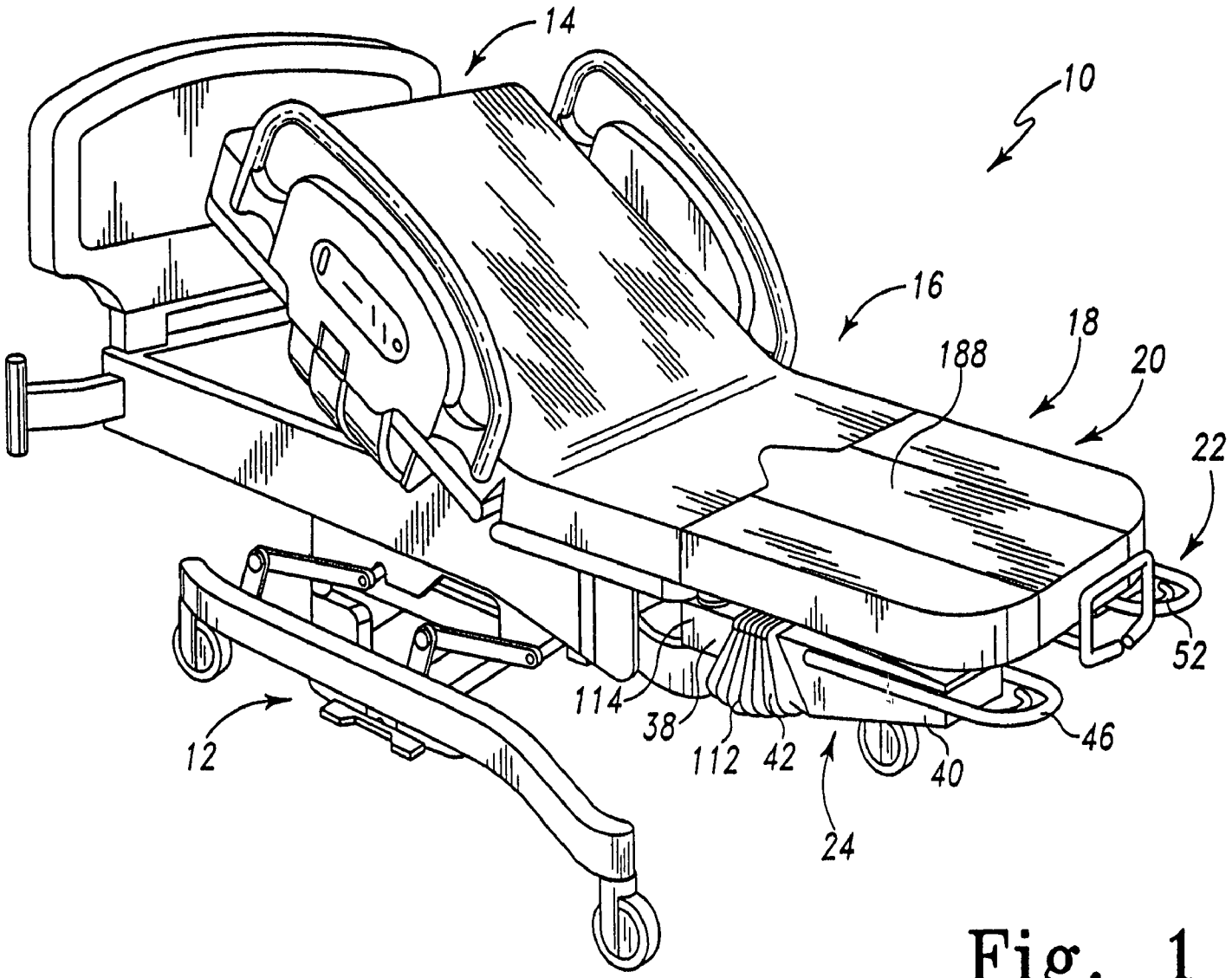
FIG. 1 is a perspective view of a patient support having a head section, a seat section, a foot section, and two foot supports positioned under the foot section.
Figure 2:
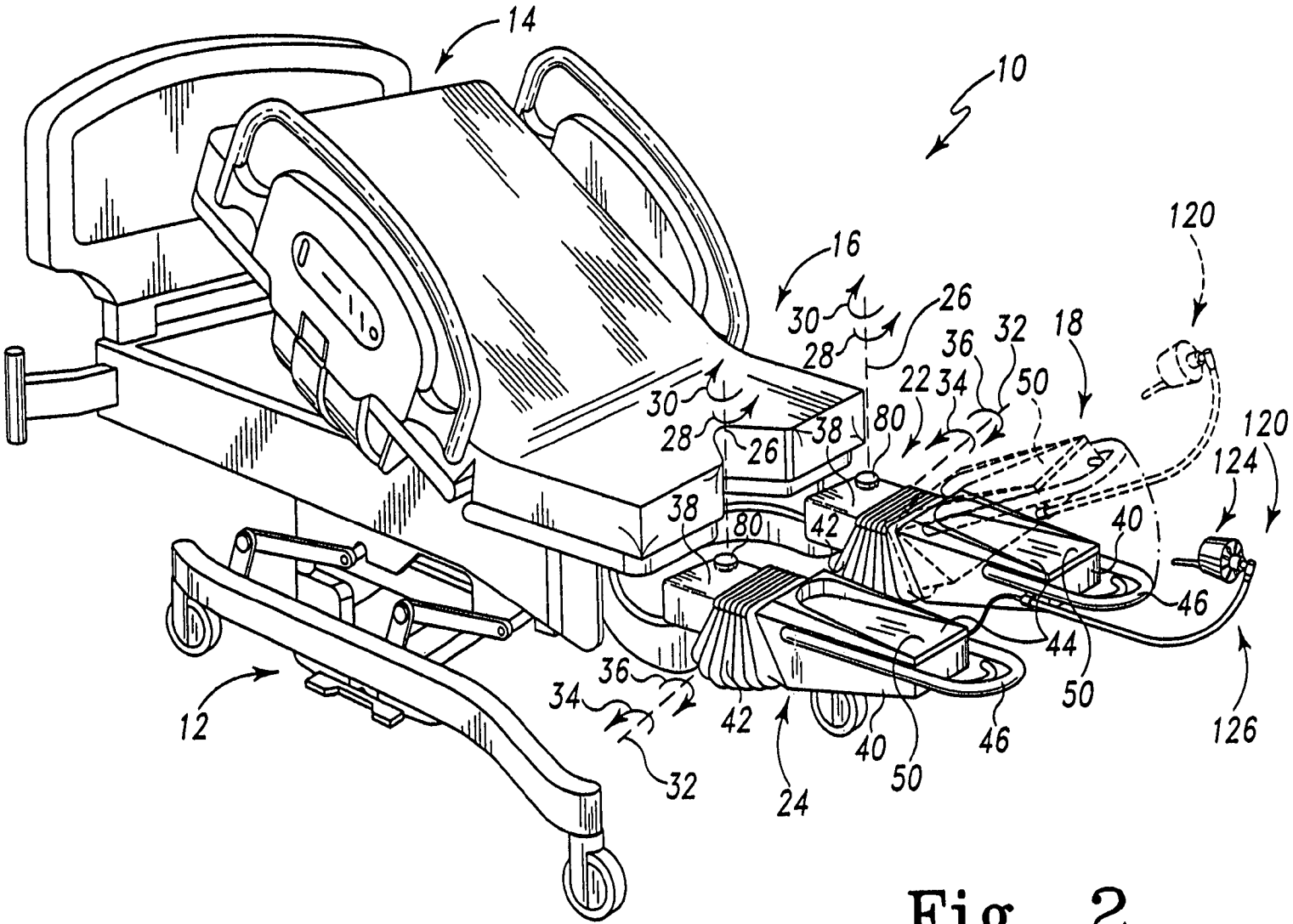
FIG. 2 is a perspective view similar to FIG. 1 showing the foot section removed to expose the foot supports and that the foot supports are movable.

A hospital bed 10 including a frame 12 supporting a patient support including a head portion 14, a seat portion 16, and a foot portion 18, is shown in FIG. 1. The head portion 14 is spaced apart from foot portion 18 by seat portion 16. As described in greater detail below, the portions 14, 16, 18 may be articulated for movement relative to each other. The foot portion 18 includes a foot section 20 and laterally spaced apart foot supports 22, 24, as shown in FIGS. 1 and 2. In the illustrated embodiment, the hospital bed 10 is a birthing bed, and foot section 20 is selectively removable from the remainder of hospital bed 10 to provide access to a patient on bed 10 as shown in FIG. 2. When the foot section 20 is coupled to the remainder of bed 10, the foot supports 22, 24 are positioned under or below foot section 20 as shown in FIG. 1. Removal of the foot section 20 exposes the foot supports 22, 24 as shown in FIG. 2.

The foot supports 22, 24 are movable about a substantially vertical axis 26 in directions 28, 30 and a substantially horizontal axis 32 in directions 34, 36, as shown in FIG. 2, so that the foot supports 22, 24 may be placed in a desired position. Each foot support 22, 24 includes first and second frame sections 38, 40, a flexible housing section 42 extending between frame sections 38, 40, a foot panel 44 coupled to second frame section 40, a handle 46 coupled to second frame section 40, and position adjustment mechanism 48. The foot panel 44 is formed to include a recess 50 sized and shaped to receive a patient's foot.

Figure 4:
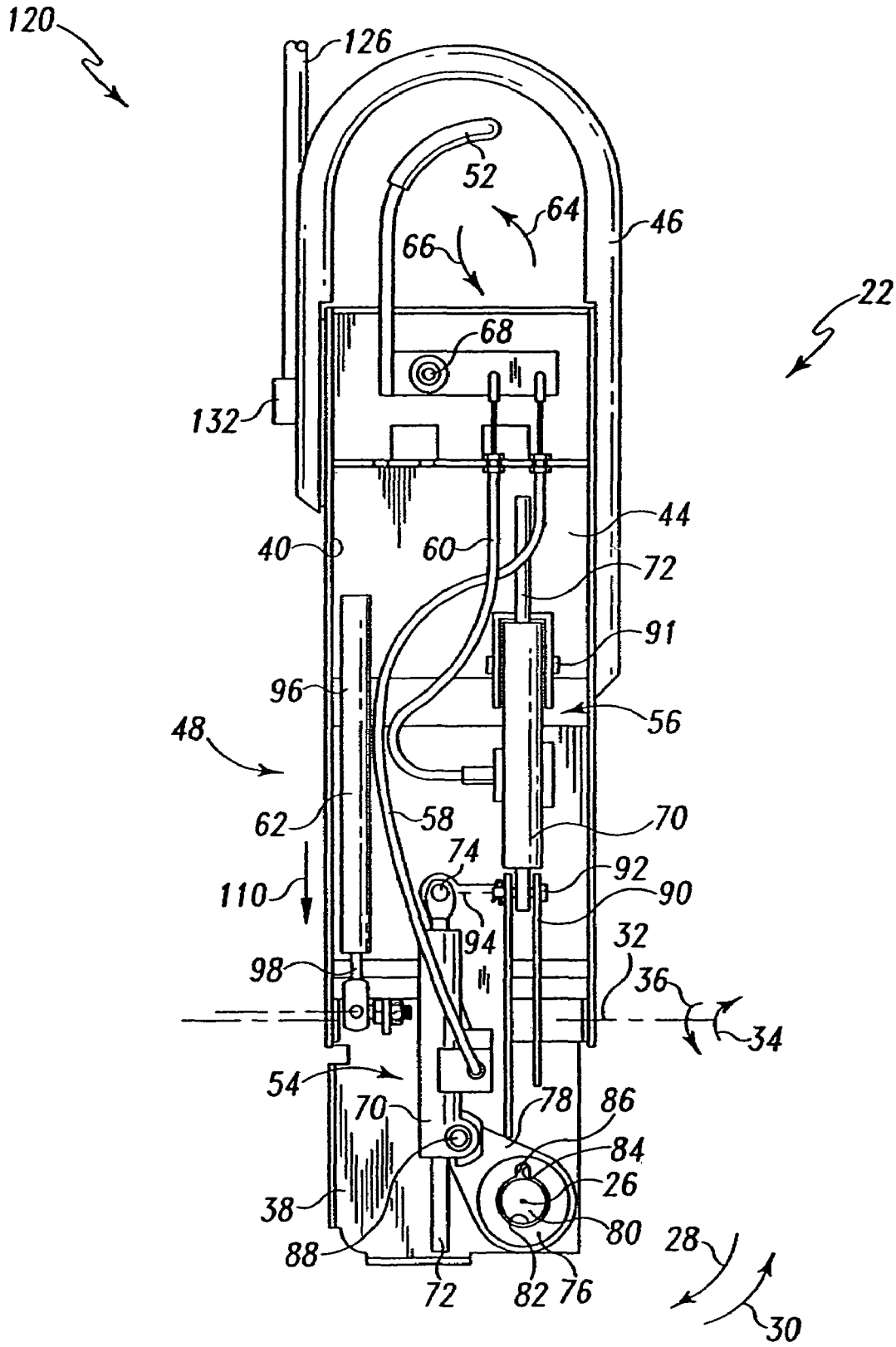
FIG. 4. is a bottom plan view of the foot support of FIG. 3, with a housing of the foot support removed for clarity, showing a position adjustment mechanism of the foot support.

The position adjustment mechanism 48 permits foot panel 44 to move relative to frame 12 about axes 26, 32 in directions 28, 30, 34, 36 so that the foot panel 44 may be positioned to receive a patient's foot in recess 50. As shown in FIG. 4, the position adjustment mechanism 48 includes a handle 52, first and second clutches 54, 56, first and second linkages 58, 60 extending between handle 52 and first and second clutches 54, 56, respectively, and a spring 62.

Figure 5:
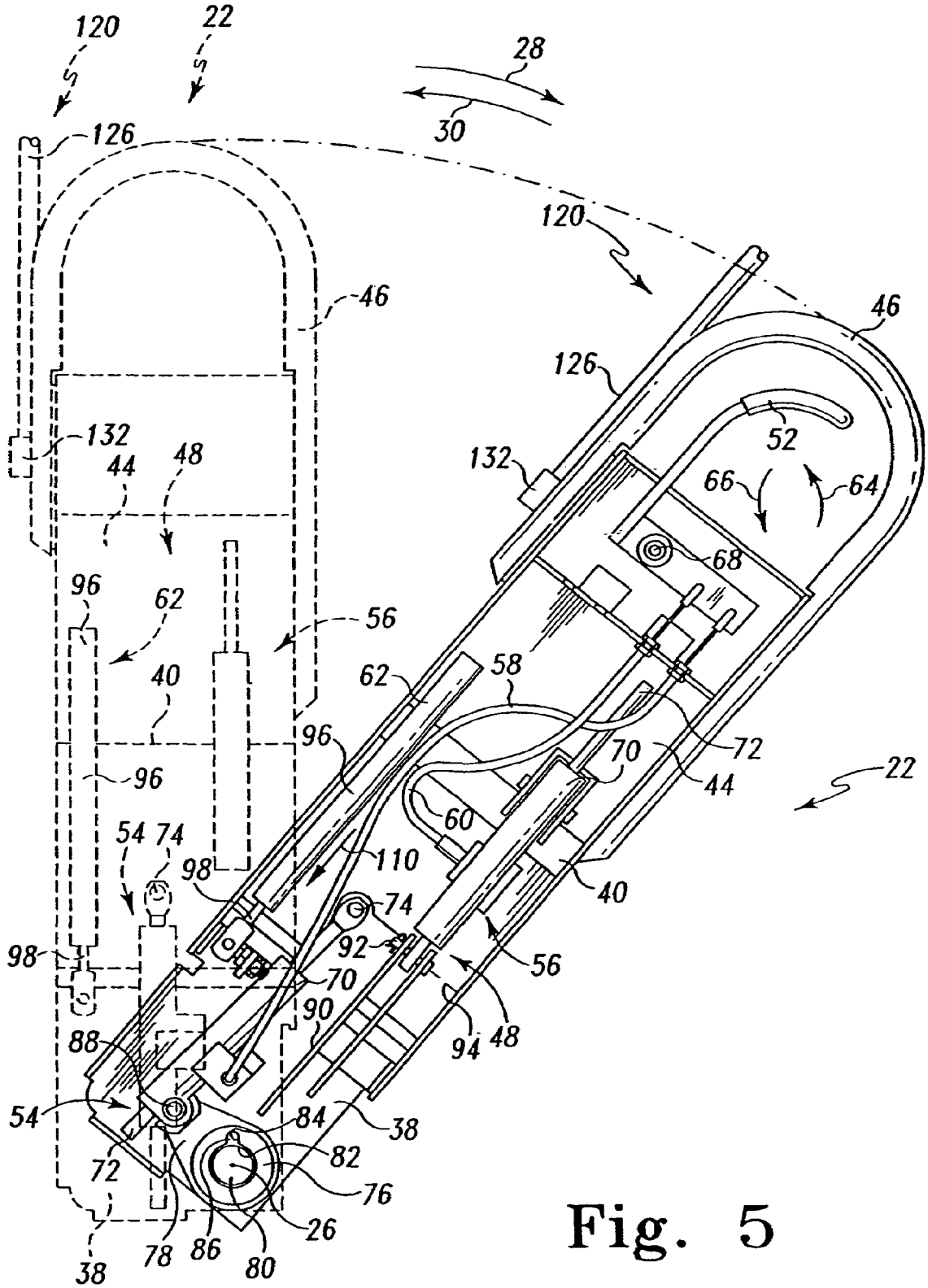
FIG. 5 is a bottom plan view similar to FIG. 4 showing the foot support being movable between first (phantom lines) and second (solid lines) rotational positions.
Figure 6:
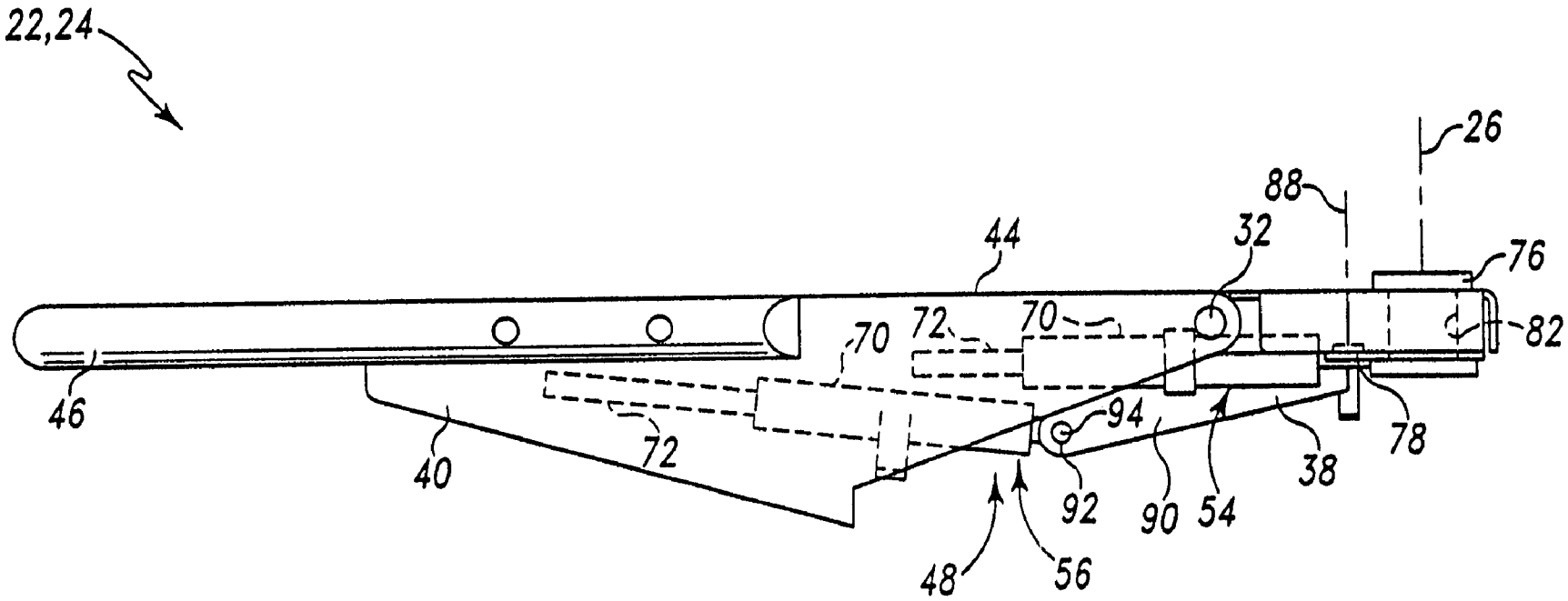
FIG. 6 is a side elevation view of the foot support showing the foot support in a substantially horizontal position.
Figure 7:
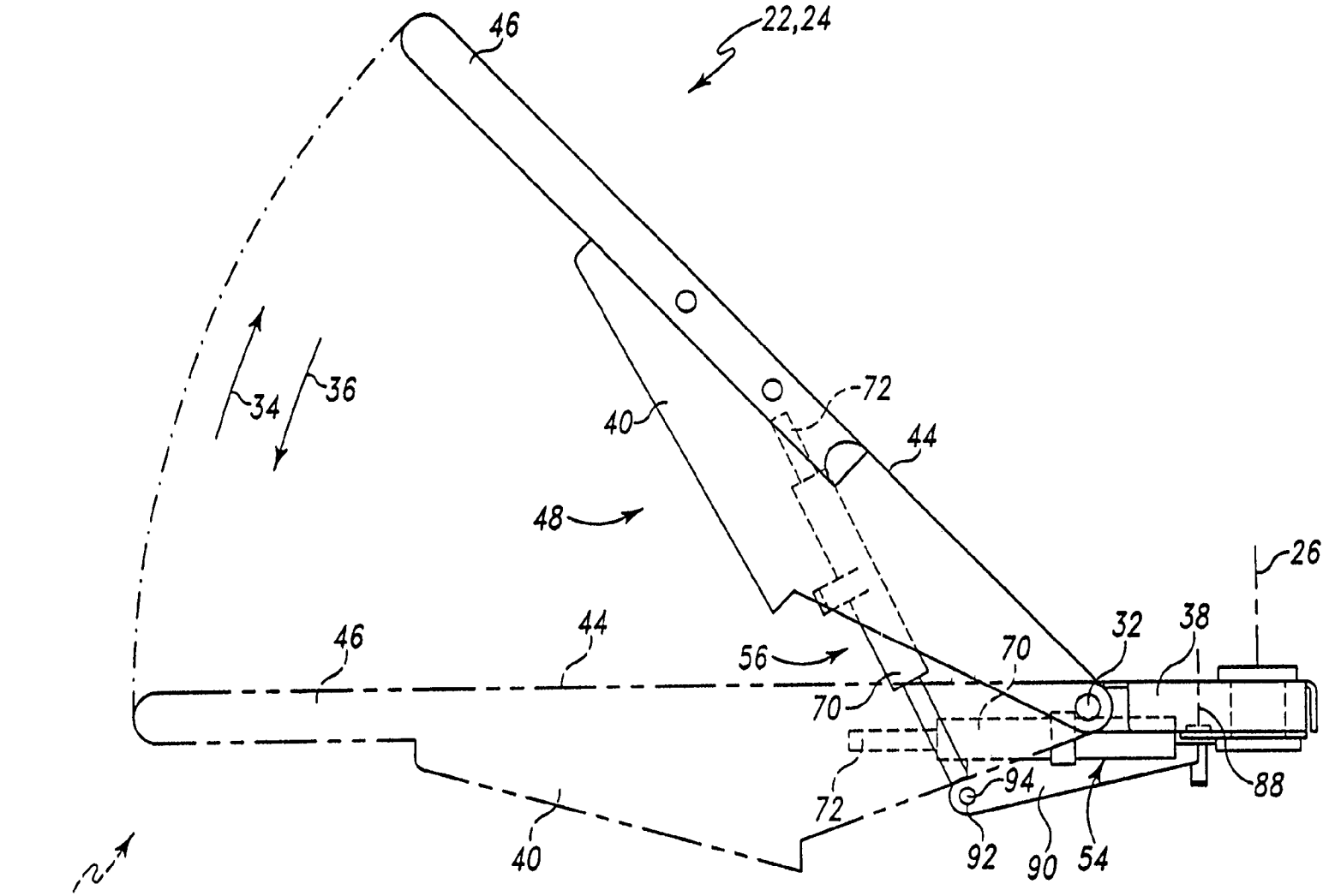
FIG. 7 is a side elevation view similar to FIG. 6 showing a portion of the foot support being movable between substantially horizontal (phantom lines) and raised (solid lines) positions.

The clutches 54, 56 may be positioned in an engaged position wherein relative movement of the foot panel 44 and frame 12 is not permitted and a disengaged position wherein relative movement is permitted. For example, when first clutch 54 is disengaged, the foot panel 44 is permitted to move relative to frame 12 about the vertical axis 26, as shown in FIGS. 4 and 5, and when the second clutch 56 is disengaged, foot panel 44 is permitted to move relative to the frame 12 about the horizontal axis 32 as shown in FIGS. 6 and 7.

To move the clutches 54, 56 between the engaged and disengaged positions, the caregiver moves the handle 52 of position adjustment mechanism 48 in directions 64, 66 about a pivot axis 68. As previously mentioned, handle 52 is coupled to the first and second linkages 58, 60 which are coupled to the first and second clutches 54, 56, respectively. In preferred embodiments, the clutches 54, 56 are normally in the engaged position and the handle 52 must be moved by the caregiver in direction 64 to disengage the clutches 54, 56. Moving the handle 52 in direction 64 about pivot axis 68 moves the linkages 58, 60 which in turn moves the clutches 54, 56 from their engaged position to their disengaged position. The handle 52 of the position adjustment mechanism 48 is positioned adjacent to handle 46 of foot support 22, 24 so that a caregiver may simultaneously grab both handles 46, 52 to disengage clutches 54, 56 and move foot support 22, 24 in directions 28, 30, 34, 36 about axes 26, 32.

Each of these clutches 54, 56 include a clamp 70 and a rod 72 that extends through clamp 70 as shown in FIG. 4. The clamp 70 is movable between an engaged position wherein the clamp 70 interacts with the rod 72 to prevent the rod 72 from moving through the clamp 70 and a disengaged position wherein the rod 72 is permitted to move through the clamp 70. Thus, the rod 72 is movable relative to the clamp 70 when the clamp 70 is in its disengaged position.

To permit movement of the foot support 24, 26 in directions 28, 30 about vertical axis 26, the clamp 70 of first clutch 54 is coupled to frame 12 and the rod 72 of first clutch 54 is coupled to the first frame section 38 of foot support 24, 26. The first frame section 38 of each foot support 24, 26 includes a rod support 74 and an end of the rod 72 of first clutch 54 is pivotally coupled to rod support 74.

The clamp 70 of first clutch 54 is coupled to frame 12 by portions of foot support 22, 24 that are fixed to frame 12. These fixed portions of foot support 22, 24 include a bushing 76 and a clamp support 78 coupled to bushing 76. The frame 12 of bed 10 includes a post 80 that extends vertically upward through an aperture 82 formed in bushing 76 as shown in FIGS. 1-5. The foot support 22, 24 rotates about this post 80 and thus post 80 defines vertical axis 26. As shown in FIGS. 4 and 5, the bushing 76 includes a keyway or slot 84 and the post 80 includes a key 86 that is positioned in slot 84 to fix the rotational position of the bushing 76 and clamp support 78 relative to the frame 12. The clamp 70 is pivotally coupled to clamp support 78 to permit pivoting of the clamp 70 relative to frame 12.

When the first clutch 54 is in the engaged position, the foot panel 44 is prevented from rotating in directions 28, 30 about vertical axis 26 defined by post 80. This rotation is prevented because the position of the rod 72 is fixed relative to the position of the clamp 70. To move the foot panel 44 about vertical axis 26, the first clutch 54 is moved to its disengaged position so the rod 72 and thus all portions of foot support 22, 24 other than bushing 76 and clamp support 78 are permitted to move relative to the clamp 70 and frame 12. When the first clutch 54 is in its disengaged position and the user moves foot support 22, 24 about vertical axis 26 in directions 28, 30, the rod 72 travels through and relative to clamp 70 along an axial path. The clamp 70 is rotatably coupled to clamp support 78 to pivot about a vertical axis 88 that is parallel to vertical axis 26 defined by post 80. When the first clutch 54 is disengaged and the caregiver moves foot support 22, 24 about vertical axis 26 in directions 28, 30, the clamp 70 rotates about this vertical axis 88 to permit the rod 72 to rotate and travel axially through clamp 70.

The second clutch 56 is similarly movable between an engaged position and a disengaged position to prevent or permit, respectively, relative movement of the first and second frame sections 38, 40 in directions 34, 36 about horizontal axis 32 as shown in FIGS. 6 and 7. Similar to the arrangement of the first clutch 54, the second clutch 56 has its rod 72 coupled to the first frame section 38 and its clamp 70 coupled to the second frame section 40. The first frame section 38 includes a rod support 90 pivotally coupled to rod 72 of second clutch 56 and the second frame section 40 includes a clamp support 91 pivotally coupled to clamp 70 of second clutch 56. A pivot pin 92 pivotally couples an end of rod 72 to rod support 90 so that rod 72 may pivot about a pivot axis 94 defined by pivot pin 92. When the second clutch 56 is in its disengaged position, the rod 72 is movable through the clamp 70 to permit the second frame section 40 to rotate in directions 34, 36 about horizontal axis 32 relative to first frame section 38 and when the clutch 56 is in its engaged position, this movement is not permitted. The rod 72 travels axially through and relative to clamp 70 and pivots about a pivot axis 94 as the second frame section 40 is rotated about horizontal axis 32.

In the illustrated embodiment, the first and second clutches 54, 56 are Mec-Lok™ clutches available from P.L. Porter Controls, Inc. of Woodland Hills, Calif. In alternative embodiments, other types of devices such as a key/slot device can be used to permit and prevent movement of the foot panel relative to the frame. In the illustrated embodiment, the linkages 58, 60 are wires that transfer the rotational motion of handle 46 to clutches 54, 56. In alternative embodiments, other types of linkages can be used including gears, mechanical links, electrical line for electrical signals, fiber-optic line for optic signals, etc.

The spring 62 is configured to assist the caregiver in moving the second frame section 40 upwardly in direction 34 about horizontal axis 32. Thus, when the caregiver moves handle 52 to disengage second clutch 56, the spring 62 biases the second frame section 40 upwardly in direction 34. This biasing force provided by the spring 62 compensates for the weight of the second frame section 40 and any force or weight generated by a patient's foot positioned in foot support 22, 24. When the caregiver lowers the foot support 22, 24 in direction 36, the caregiver must move the foot support 22, 24 against the biasing force of the spring 62. However, the caregiver is assisted in moving against the biasing force by the weight of the second frame section 40 and possibly a force and/or weight from a patient's foot.

In the illustrated embodiment, the spring 62 is a gas spring having a cylinder 96 pivotally coupled to second frame section 40 and a piston 98 pivotally coupled to first frame section 38 as shown in FIGS. 4 and 5. The gas spring 62 is configured to bias piston 98 away from cylinder 96 in direction 110 to assist the caregiver in raising second frame section 40 as discussed above. In alternative embodiments other devices such as a coil spring can be used to assist a caregiver in raising the second frame section relative to the first frame section.

Figure 3:
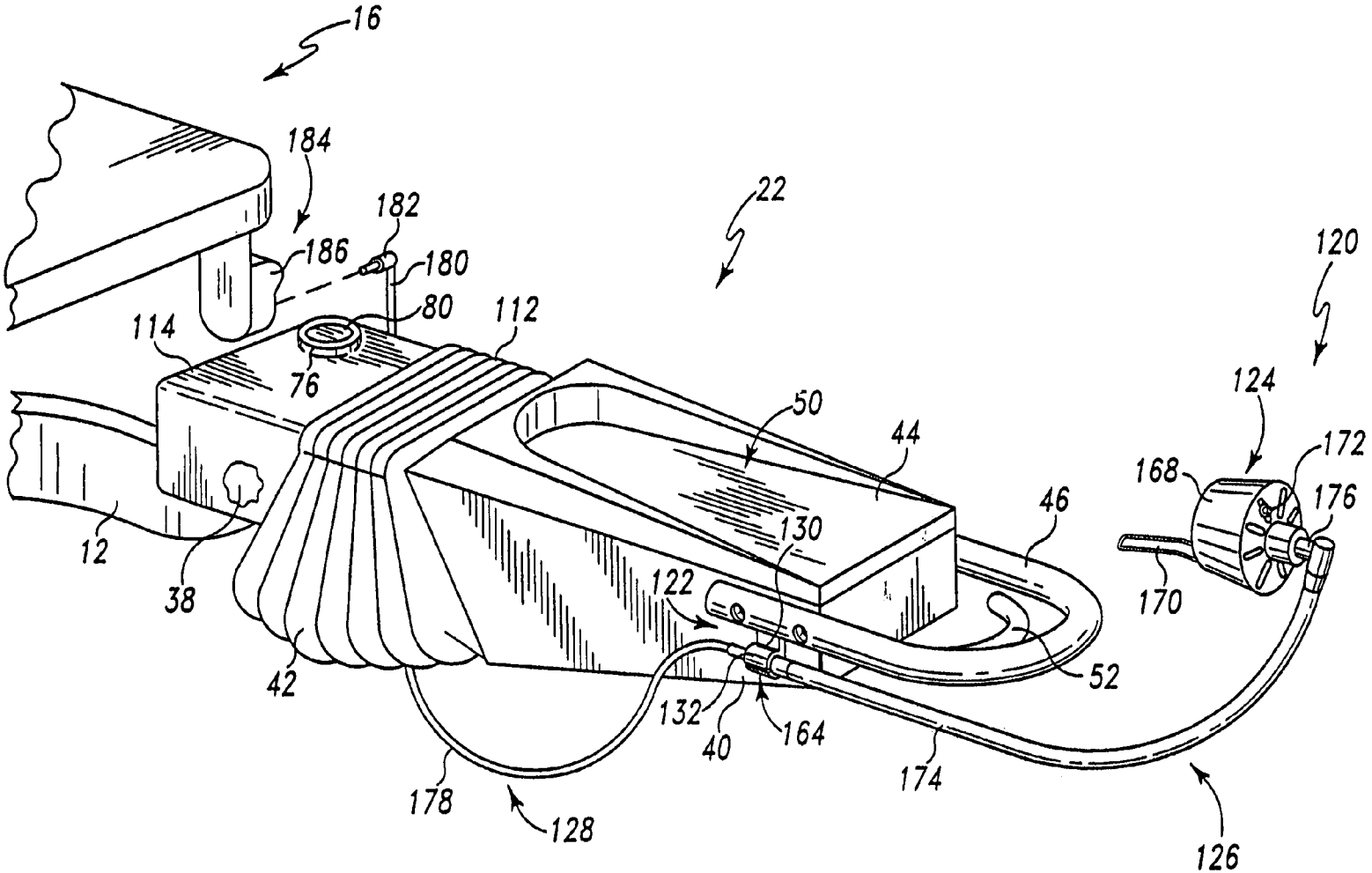
FIG. 3 is a perspective view of one of the foot supports showing a light source coupled to the foot support.

Referring further to FIG. 3, the flexible housing section 42 includes a bellows portion 112 extending between the first and second frame sections 38, 40 and a cover portion 114 that covers the first frame section 38. When second frame section 40 is moved relative to first frame section 38, the flexible housing section 42 expands and contracts to maintain a continuous housing for the clutches 54, 56, spring 62, and linkages 58, 60. The flexible housing section 42 cooperates with the first and second frame sections 38, 40 to prevent or at least minimize substances from coming into contact with for the clutches 54, 56, spring 62, and linkages 58, 60.

Figures 8, 9:
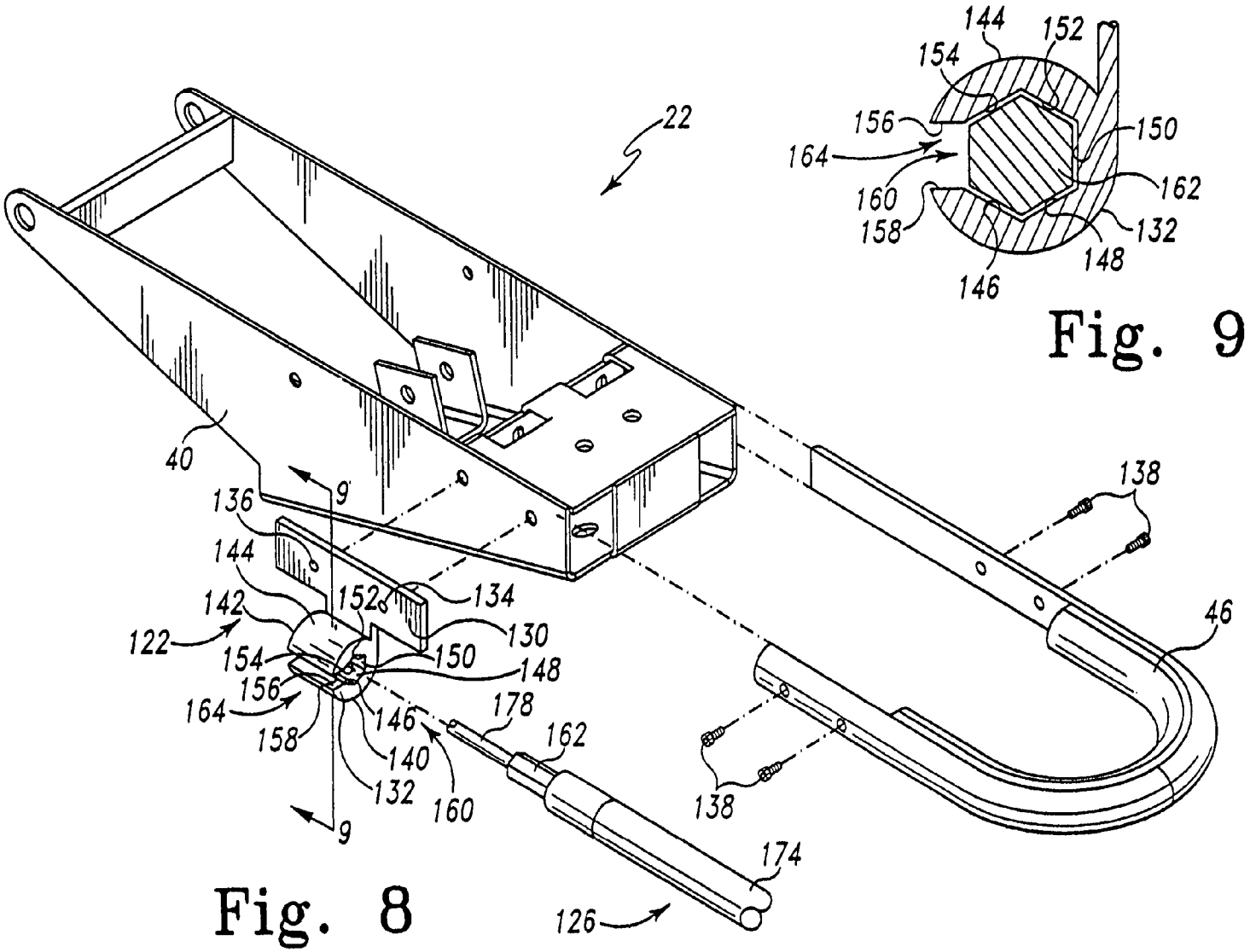
FIG. 8 is an exploded perspective view of a portion of the foot support and a portion of the light source.
FIG. 9 is a cross-sectional view taken along line 9-9 of FIG. 8, illustrating the arm inserted into the bracket.

The hospital bed 10 further includes a light assembly 120 coupled to foot support 22 as shown in FIGS. 2 and 3. The light assembly 120 includes a base bracket 122, a light source 124, an arm 126 extending between base bracket 122 and light source 124, and a power cord 128. The base bracket 122 includes a base 130 and arm coupler 132 that receives and holds arm 126. The base 130 includes first and second apertures 134, 136 and is coupled to a second frame section 40 of foot support 22 by screws or couplers 138 extending through apertures 134, 136 as shown in FIGS. 3 and 8. These same screws 138 couple handle 46 to second frame section 40. To install bracket 122, the screws 138 are removed, the bracket 122 is positioned between handle 46 and second frame section 40, and the screws 138 are threaded through handle 46 and apertures 134, 136 of bracket 122 and into second frame section 40. In alternative embodiments, the base 130 includes first and second slots (not shown) and the bracket 122 is installed by loosening the screws 138 instead of removing the screws 138, sliding the bracket 122 between the handle 46 and second frame section 40 so that the screws 138 are received in the slots, and then tightening the screws 138.

Referring now to FIGS. 8 and 9, the arm coupler 132 of bracket 122 is C-shaped and includes spaced-apart end surfaces 140, 142, a substantially circular-shaped outer surface 144 extending between end surfaces 140, 142, and seven distinct, separate inner surfaces 146, 148, 150, 152, 154, 156, 158 extending between end surfaces 140, 142. Five of the inner surfaces 146, 148, 150, 152, 154 define a hexagonal-shaped opening 160 in which arm 126 is placed to couple arm 126 to bracket 122. The arm 126 includes a hexagonal-shaped member 162 that is sized and shaped to extend into, be positioned within, and mate with hexagonal-shaped opening 160 of bracket 122 to couple arm 126 and bracket 122 as shown in FIGS. 3, 8 and 9. The other two inner surfaces 156, 158 define a slot 164 that communicates with hexagonal-shaped opening 160. In the illustrated embodiment, both the slot 164 and hexagonal-shaped opening 160 extend from end surface 140 to end surface 142. In alternative embodiments, the arm coupler 132 may define an opening having any shape and the arm 126 may include a member sized and shaped to be positioned within the opening to couple the arm 126 and bracket 122. In other alternative embodiments, the arm coupler 132 may be any structure that receives and holds the arm 126. For example, the arm coupler 132 may include resilient first and second portions that are movable relative to each other and that cooperate to define an opening. When the arm 126 is positioned in the opening, the first and second portions initially expand to receive the arm 126 and then compress the arm 126 to couple the arm 126 to the bracket 122.

Figure 10:
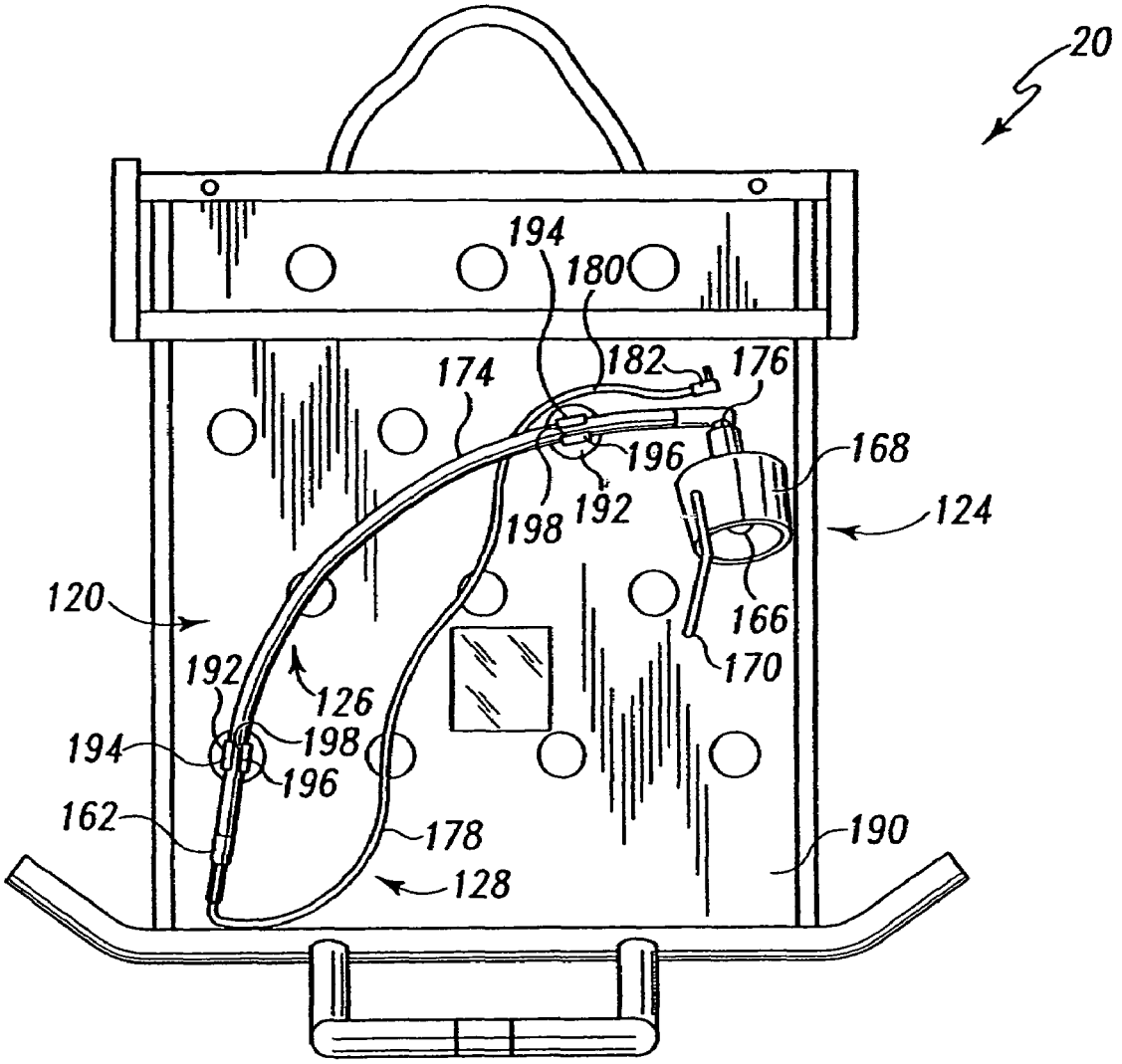
FIG. 10 is an elevation view of the light source coupled to a storage surface of the foot section of the bed.

With reference to FIGS. 3 and 10, the light source 124 includes a light 166, a light housing 168, a handle 170 coupled to the housing 168, and a power switch 172 coupled to housing 168. In the illustrated embodiment, the arm 126 includes a flexible link or portion 174 and a universal joint 176 coupling the light housing 168 to the flexible portion 174. The flexible portion 174 and universal joint 176 permit a caregiver to grab handle 170 of light source 124 and move the light source 124 to a desired position and orientation. The combination of the flexible portion 174 and universal joint 176 gives the arm 126 six degrees of freedom. In alternative embodiments, the arm may include any number of rigid and flexible links, joints, etc. to provide the arm with any number of degrees of freedom so that the light source may be positioned in a desired location and/or orientation.

The power cord 128 includes a power line 178 having a first end (not shown) coupled to light source 124 and a second end 180 and a coupler or plug 182 coupled to second end 180 of power line 178. The power line 178 extends from light source 124, through arm 126 and bracket 122, to coupler 182. When the arm 126 is coupled to bracket 122, the hexagonal-shaped member 162 of arm 126 is positioned in hexagonal-shaped opening 160 formed in the bracket 122 and the power line 178 is pushed through the slot 164 formed in bracket 122 so that the power line 178 extends through the hexagonal-shaped opening 160 defined in arm coupler 132 of bracket 122.

The hospital bed 10 further includes a power supply 184 coupled to seat portion 16 of bed 10 as shown in FIGS. 3. The coupler or plug 182 of power cord 128 is plugged into this power supply 184 to provide power to light source 124. In the preferred embodiment, the power supply 184 includes a housing 186 and a jack (not shown) within the housing 186. In alternative embodiments, the plug of the power cord may be connected to other sources of power including those remote from the bed 10.

When the light assembly 120 is not in use, the caregiver may store the light assembly 120 within a storage area 187 positioned on the underside of the removable foot section 20 of bed 10. The foot section 20 includes an upper surface 188 that faces upwardly toward a patient lying on foot section 20, a lower or storage surface 190 facing downwardly away from the patient, and retaining members, such as clips or couplers 192, coupled to the lower surface 190. The clips 192 are configured to releasably receive and hold arm 126 of light assembly 120. In the illustrated embodiment, the couplers 192 are resilient clips that snap over arm 126 of light assembly 120. The clips 192 may comprise opposing first and second arms 194 and 196 separated by an opening or slot 198. In operation, the arm 126 of light assembly 120 passes through the slot 198 and is releasably retained by the arms 194 and 196. It should be readily apparent that in alternative embodiments, the light assembly 120 may be releasably coupled to foot section by other retaining members. For example, the light source 120 may be coupled to the foot section 20 by a single clip, one or more hook and loop fasteners, one or more clamps, or a combination of conventional retaining members.

Figure 11:
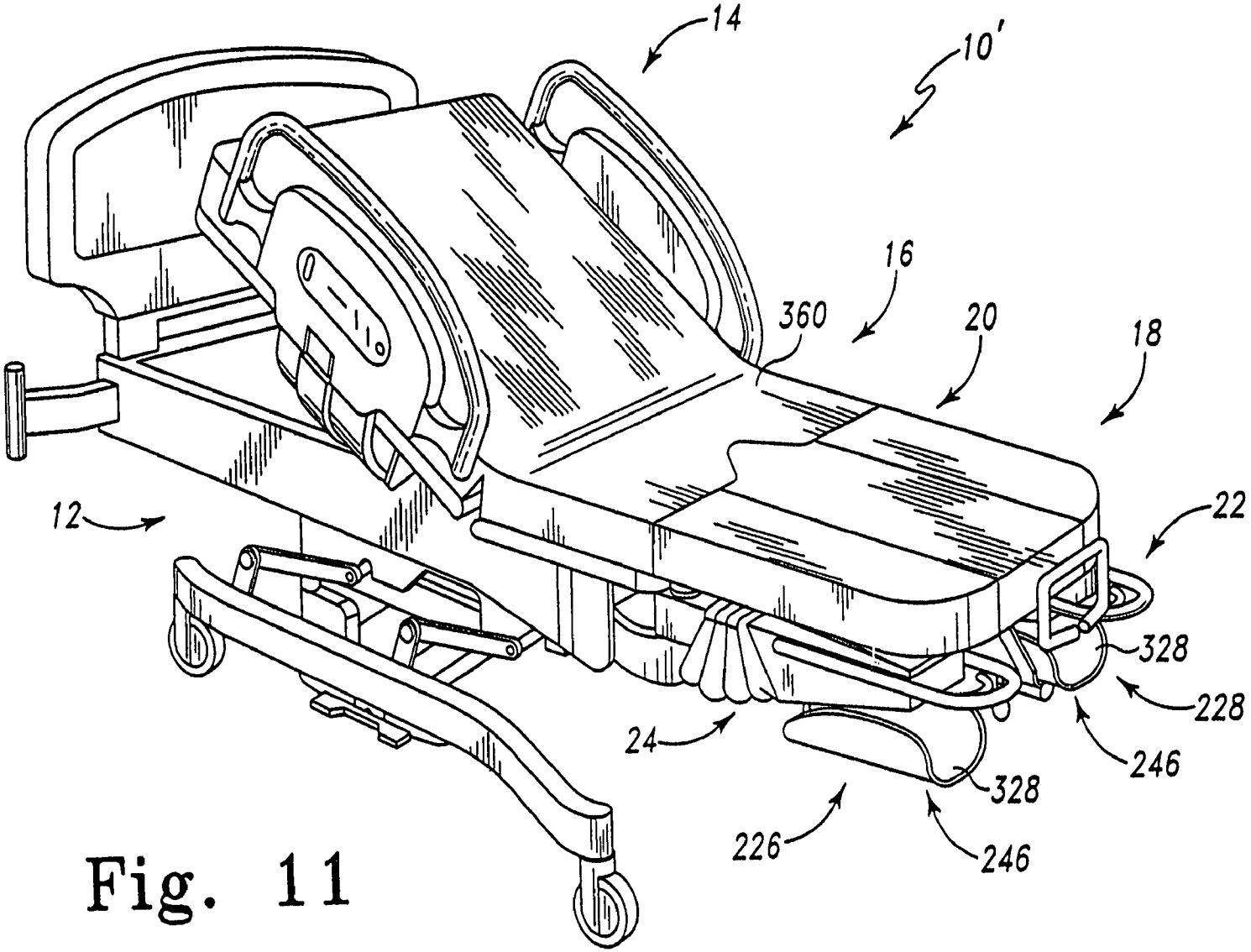
FIG. 11 is a perspective view of an alternative embodiment patient support having a head portion, a seat portion, and a foot portion, the foot portion including a foot section and two foot supports positioned under the foot section.
Figure 12:
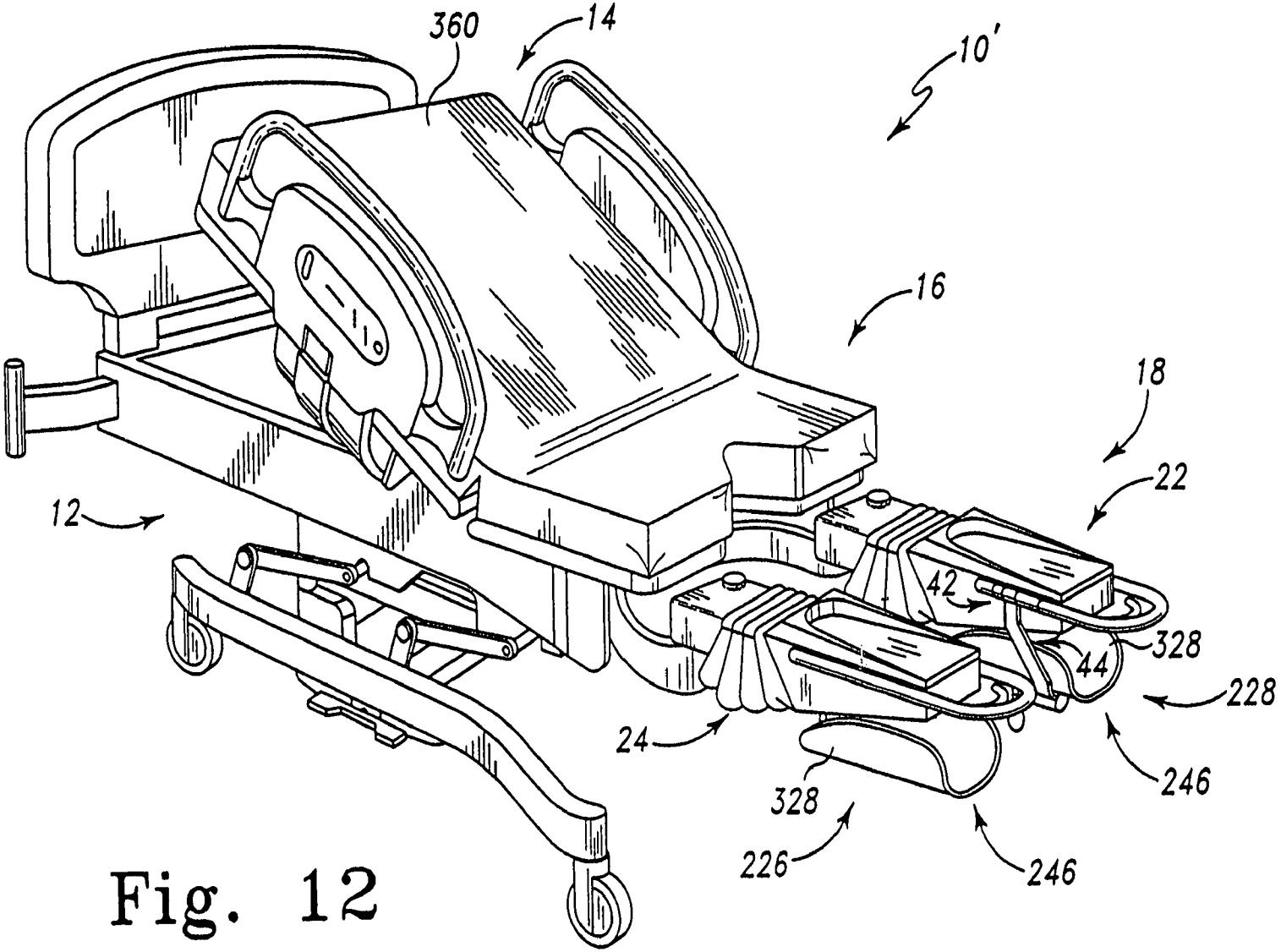
FIG. 12 is a perspective view similar to FIG. 11 showing the foot section removed to expose the foot supports and the patient support further including a calf support positioned under each foot support.

An alternative embodiment hospital bed 10' is illustrated in FIG. 11 as including a frame 12 supporting a patient support. The patient support includes a head portion 14, a seat portion 16, and a foot portion 18. The foot portion 18 includes a foot section 20, foot supports 22, 24, and calf supports 226, 228 as shown in FIGS. 11 and 12. In the illustrated embodiment, the hospital bed 10' is a birthing bed, and foot section 20 is selectively removable from the remainder of hospital bed 10' to provide access to a patient on bed 10' as shown in FIG. 12. When the foot section 20 is coupled to the remainder of bed 10', the foot supports 22, 24 and calf supports 226, 228 are positioned under or below foot section 20 as shown in FIG. 11. Removal of the foot section 20 exposes the foot supports 22, 24 and calf supports 226, 228 as shown in FIG. 12.

Figure 13:
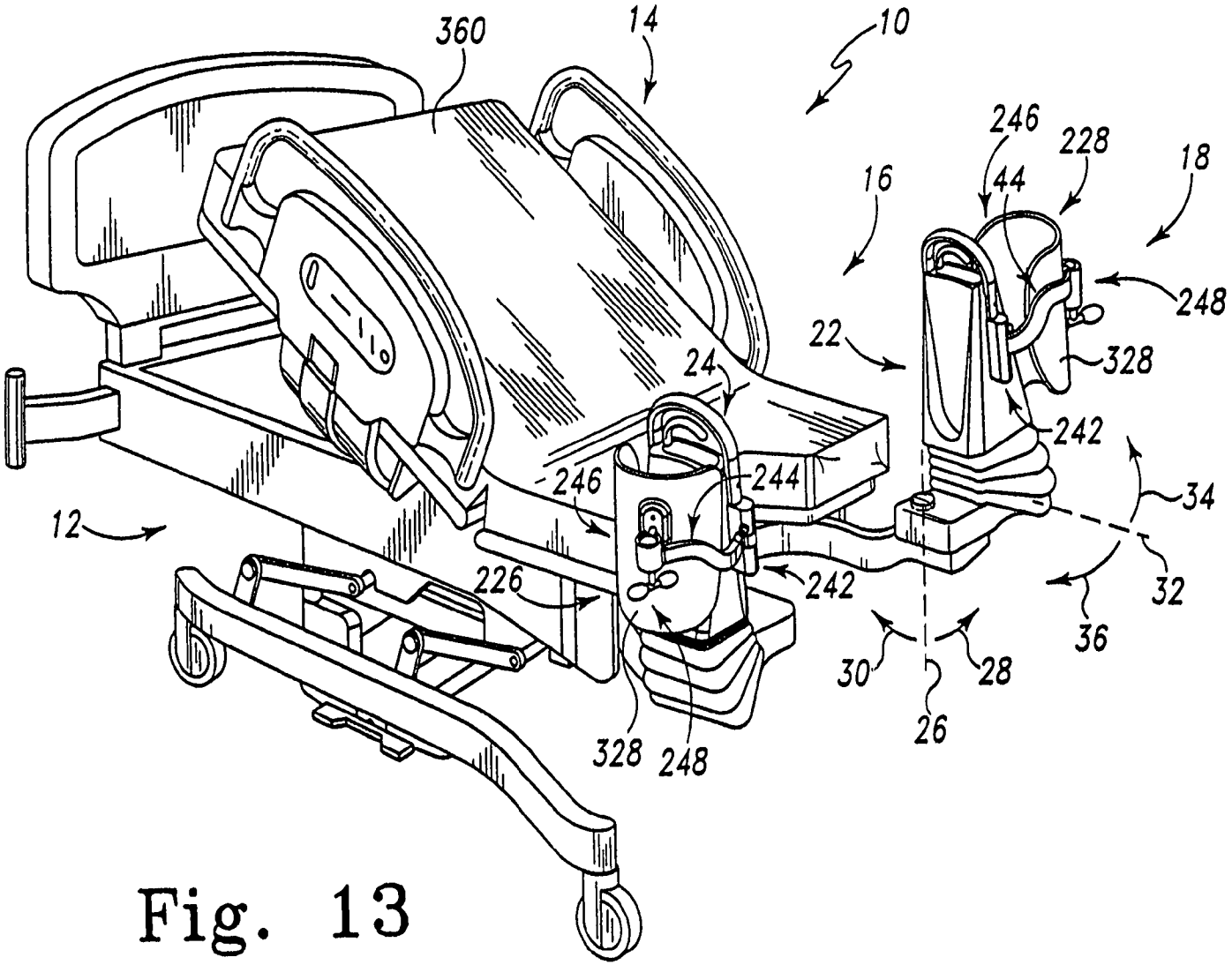
FIG. 13 is a perspective view similar to FIG. 12 showing each of the foot supports being rotated outwardly about a substantially vertical axis and upwardly about a substantially horizontal axis.

The foot supports 22, 24 are movable about a substantially vertical axis 26 in directions 28, 30 and a substantially horizontal axis 32 in directions 34, 36, as shown in FIG. 13, so that the foot supports 22, 24 may be placed in a desired position. The foot supports 22, 24 are identical to those described above in detail with respect to FIGS. 1-7.

Figure 14:
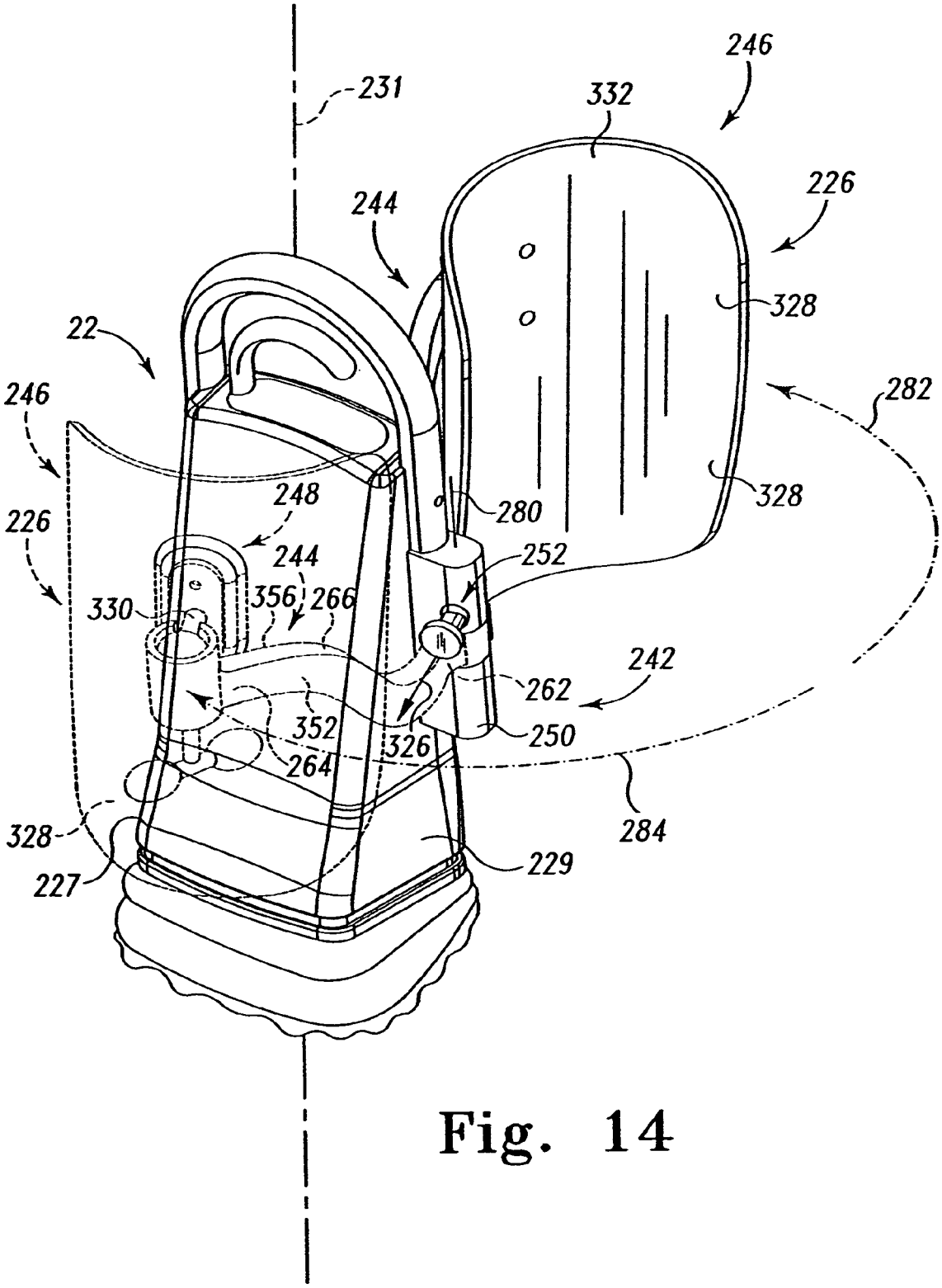
FIG. 14 is a perspective view of one of the calf supports of FIG. 13 showing the calf support including a foot support coupler, a calf holder, an arm extending from the foot support coupler toward the calf holder, and another coupler positioned between the arm and the calf holder and the arm and calf holder of the calf support being movable between a storage position (phantom lines) and a use position (solid lines)
Figure 16:
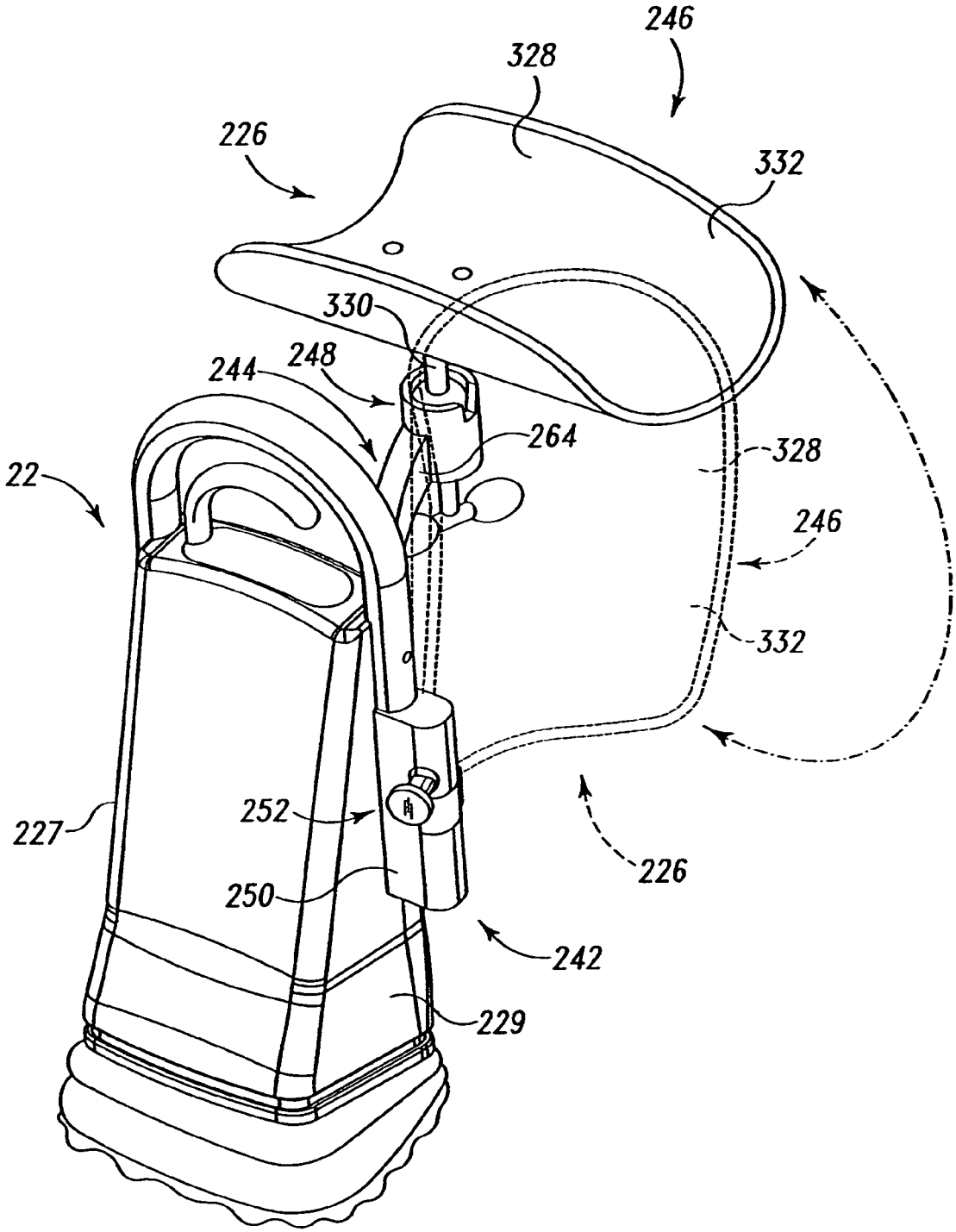
FIG. 16 is a perspective view similar to FIG. 14 showing the calf holder of the calf support being rotated from a storage position (phantom lines) to a use position (solid lines)

The calf supports 226, 228 are coupled to one of the laterally spaced opposing side edges 227 and 229 of the foot supports 22, 24, respectively (FIGS. 14 and 16). A longitudinal axis 231 of each foot support 22, 24 is defined intermediate the side edges 227 and 229. As such, the calf supports 226 and 228 move with and relative to foot supports 22, 24, respectively. As shown in FIG. 13, the calf supports 226, 228 move with the foot supports 22, 24 as the foot supports 22, 24 are moved about the vertical and horizontal axes 26, 32. In addition, the calf supports 226, 228 are movable relative to the foot supports 22, 24 between a storage position shown in FIG. 13 and a use position shown in FIG. 18.

Figure 15:
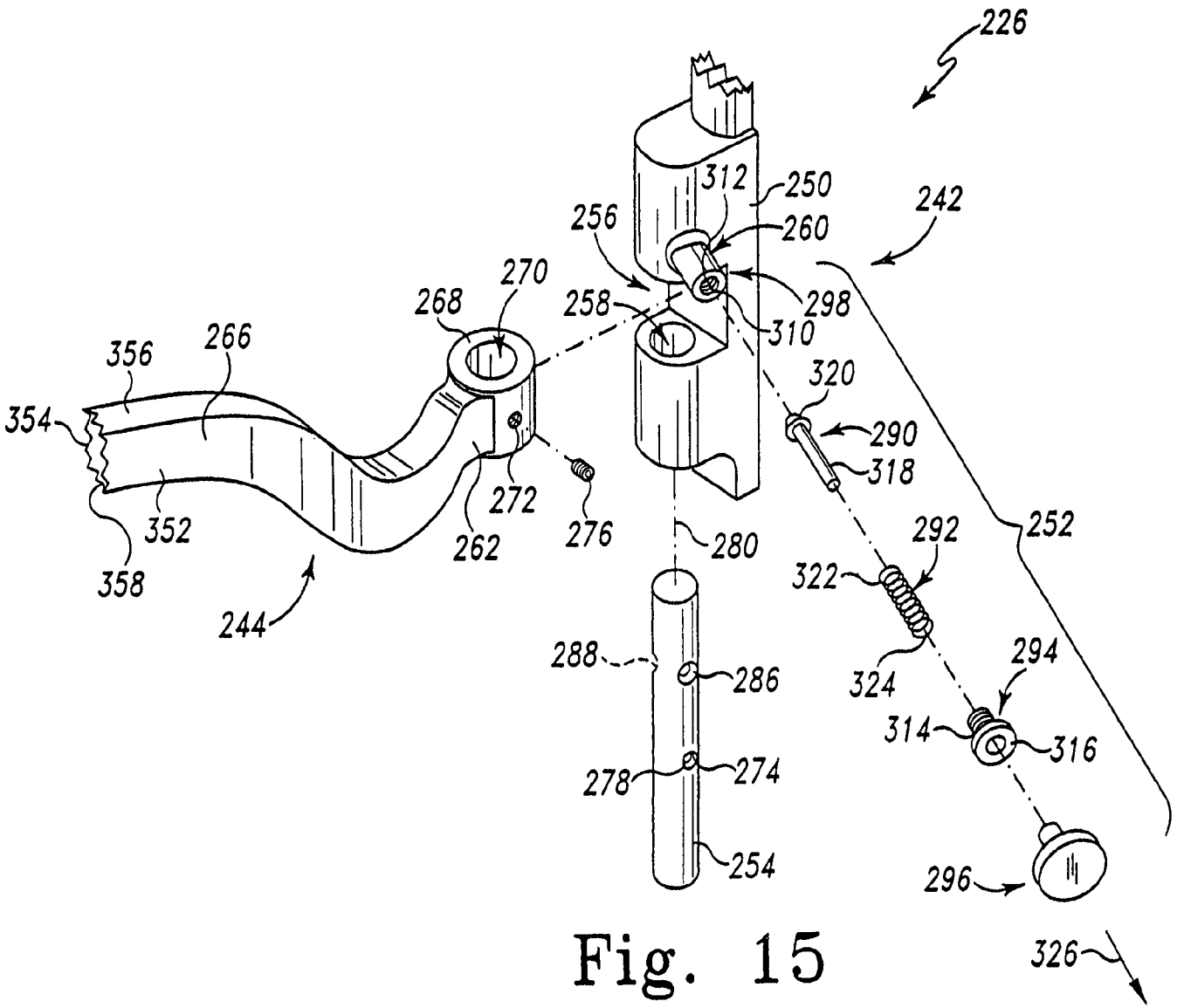
FIG. 15 is an exploded perspective view of the foot support coupler and a portion of the arm of the calf support.

Each calf support 226, 228 includes a foot support coupler 242, an arm 244, a calf holder 246, and a calf holder coupler 248 positioned between calf holder 246 and arm 244 as shown in FIG. 14. The foot support coupler 242 includes a body 250 coupled to foot support 22, 24, a detent 252, and a rod 254 as shown in FIGS. 14 and 15. The body 250 includes a first aperture 256 sized to receive arm 244, a second aperture 258 sized to receive rod 254, and a third aperture 260 sized to receive the detent 252. The arm 244 includes a first end 262 coupled to foot support coupler 242, a second end 264 coupled to coupler 248, and a central portion 266 extending between the first and second ends 262, 264. The first end 262 of arm 244 includes a collar 268 that defines a collar aperture 270. Arm 244 and rod 254 each include a set screw aperture 272, 274 and the foot support coupler 242 further includes a set screw 276 as shown in FIG. 15.

The collar 268, rod 254, and set screw 276 cooperate to couple arm 244 and foot support coupler 242. Collar 268 of arm 244 is positioned in first aperture 256 of body 250 and rod 254 is positioned in second aperture 258 of body 250 and collar aperture 270 of arm 244. The set screw 276 is positioned in set screw apertures 272, 274 of collar 268 and rod 254, respectively, to couple arm 244 to rod 254. The set screw aperture 274 of rod 254 is defined by generally conical-shaped sidewalls 278 and the end of set screw 276 that engages the conical-shaped sidewalls 278 of rod 254 is tapered.

As shown in FIG. 14, the arm 244 and calf holder 246 of calf supports 226, 228 are movable relative to foot supports 22, 24 about an axis 280 in directions 282, 284 between a storage position, as shown in phantom lines, and a use position, as shown in solid lines. The axis 280 is disposed substantially parallel to the longitudinal axis 231 of the respective foot support 22, 24. The detent 252 interacts with rod 254 to control movement of the rod 254, arm 244, and calf holder 246 about axis 280 which is defined by rod 254. The rod 254 includes spaced-apart first and second apertures 286, 288 that interact with detent 252. The arm 244 is locked in position relative to foot support coupler 242 in the storage and use positions by the interaction of detent 252 and the apertures 286, 288 in the rod 254 of arm 244. The detent 252 is biased toward the rod 254 so that when one of the apertures 286, 288 of the rod 254 are aligned with the detent 252, a portion of the detent 252 extends into the aperture 286, 288 to secure the position of the rod 254, arm 244, and calf holder 246 relative to foot support 22, 24. When the arm 244 is in the storage position, aperture 286 is aligned with the detent 252 to permit the rod 254, arm 244, and calf holder 246 to be secured in the storage position and, similarly, when the arm 244 is in the use position, aperture 288 is aligned with the detent 252 to permit the rod 254, arm 244, and calf holder 246 to be secured in the use position.

As shown in FIG. 15, the detent 252 includes a pin 290, a spring 292, a cap 294, a handle 296, and a housing 298. The housing 298 is positioned in third aperture 260 of body 250 of foot support coupler 242 and includes a threaded inner surface 310 which defines an interior region 312. The pin 290 and spring 292 are positioned and held in the interior region 312 of housing 298 by cap 294. The cap 294 includes a threaded projection 314 that extends into and engages the threaded inner surface 310 of housing 298 and a flange 316 that abuts the housing 298.

Pin 290 is the portion of detent 252 that extends into apertures 286, 288 to secure the position of rod 254, arm 244, and calf holder 246 relative to foot support 22, 24. The spring 292 biases the pin 290 toward rod 254 to force pin 290 into apertures 286, 288 and maintains a positive locking relationship when pin 290 is aligned with one of the apertures 286, 288. The pin 290 includes a rod 318 and a head 320 coupled to rod 318. The head 320 includes a larger diameter compared to rod 318 and extends into the apertures 286, 288 to lock the position of rod 254, arm 244, and calf holder 246 relative to foot support 22, 24. The rod 318 extends through spring 292 and cap 294 and is coupled to handle 296. The spring 292 includes a first end 322 that abuts the head 320 of rod 318 and a second end 324 that abuts flange 316 of cap 294. Because the pin 290 is only fixed to handle 296 and the position of cap 294 is fixed relative to foot supports 22, 24, the spring 292 biases the head 320 of pin 290 toward rod 254.

To move the rod 254, arm 244, and calf holder 246 about axis 280, a caregiver pulls handle 296 of detent 252 outwardly in direction 326 until head 320 of pin 290 is no longer positioned in an aperture 286, 288 of rod 254 of arm 244. This movement of handle 296 in direction 326 compresses spring 292. When pin 290 no longer locks rod 254, a caregiver may rotate arm 244 toward the desired position. While rotating arm 244, the caregiver releases handle 296 so that spring 292 biases pin 290 toward rod 254 to position head 320 of pin 290 adjacent to rod 254 and continues rotating arm 244 until head 320 of pin 290 "finds", or is seated, and extends into the other aperture 286, 288 to lock arm 244 and calf holder 246 relative to foot support 22, 24 in the desired position. In alternative embodiments, more than two apertures may be provided on the rod 254 to provide additional positions where the arm 244 and calf holder 246 may be secured relative to the foot support 22, 24. In other alternative embodiments, the arm 244 may be coupled to the foot supports 22, 24 by other conventional mechanisms.

The calf holder 246 includes a dish 328 that is adapted to receive and support a patient's calf and a rod 330 coupled to dish 328 as shown in FIG. 6. The dish 328 includes a curved calf support surface 332 on which the patient's calf lies when being supported by calf support 226, 228. In preferred embodiments, a pad (not shown) is placed on calf support surface 332 of dish 328.

Coupler 248 permits the calf holder 246 to move relative to arm 244 and foot supports 22, 24 between a storage position, shown in phantom lines in FIG. 16, and a use position, shown in solid lines in FIG. 16. In the use position, the calf support surface 332 is placed in a position to abut and support a patient's calf.

Figure 17:
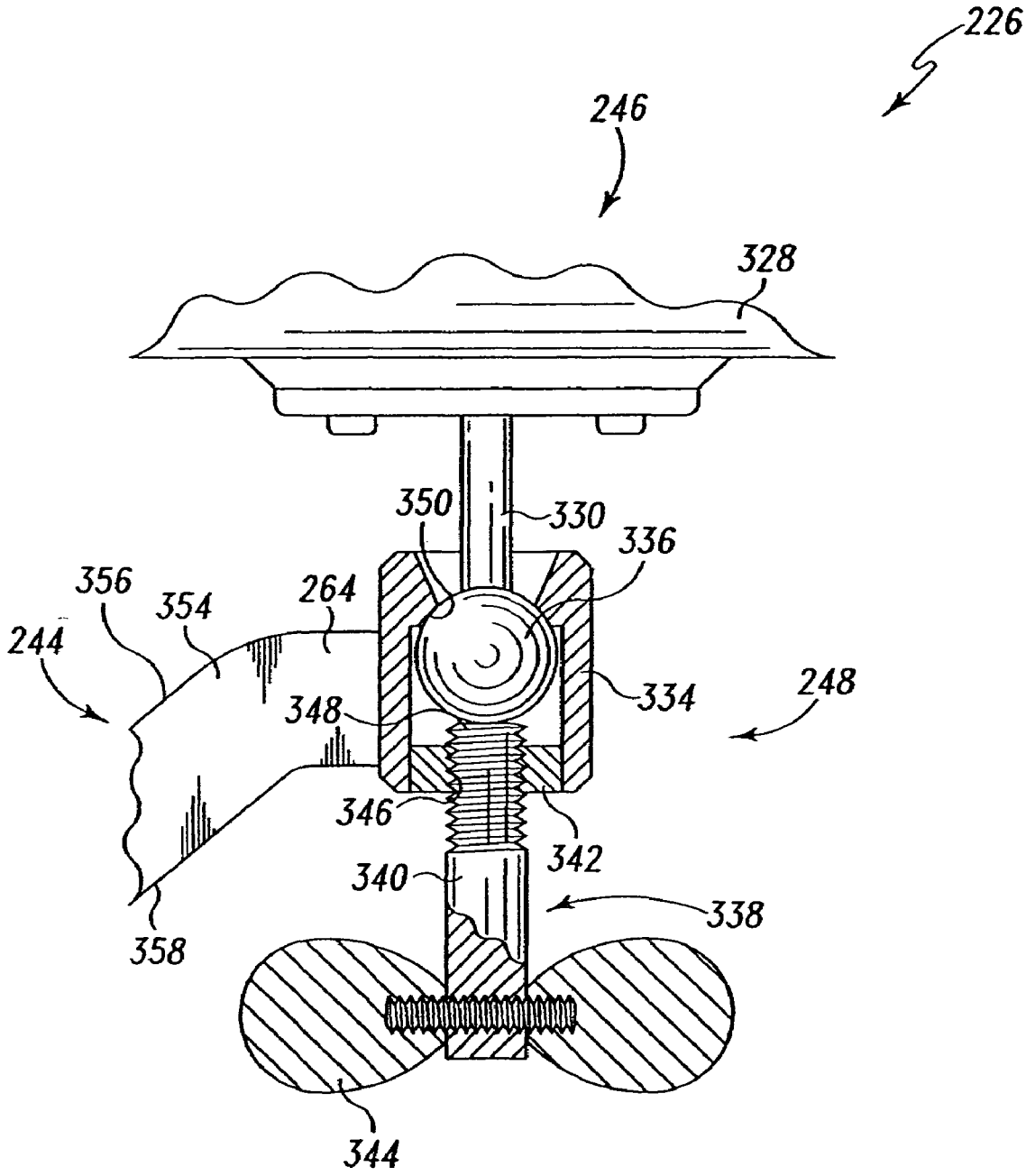
FIG. 17 is an elevational view, with portions cutaway, of the coupler and portions of the arm and calf holder showing the coupler coupling the arm to the calf holder.

In the illustrated embodiment, the dish 328 and thus the calf support surface 332 can be placed in an infinite number of positions because the coupler 248 is a universal or ball joint-type coupler. The coupler 248 includes a sleeve 334, a ball 336 positioned in sleeve 334, and a lock 338 as shown in FIG. 17. One portion of the coupler 248, ball 336, is coupled to the rod 330 of calf holder 246 and another portion of coupler 248, sleeve 334, is coupled to second end 264 of arm 244.

The lock 338 is movable between a locked position wherein the positions of the ball 336 and sleeve 334 are fixed relative to each other and an unlocked position wherein the ball 336 is permitted to move relative to sleeve 334. When the lock 338 is in the locked position, the calf holder 246 is fixed relative to arm 244 and when the lock 338 is in the unlocked position, the calf holder 246 is permitted to move relative to arm 244.

The lock 338 includes a threaded stud 340, a cap 342 coupled to sleeve 334, and a handle 344 coupled to stud 340. The cap 342 includes a threaded aperture 346 and the stud 340 is configured to pass through aperture 346 in cap 342 as stud 340 is threaded in and out of aperture 346. The stud 340 includes a surface 348 that faces toward ball 336 and is configured to engage and force ball 336 into contact with sleeve 334.

The sleeve 334 includes a curved surface 350 which abuts ball 336 when ball 336 is forced into contact with sleeve 334 by lock 338. In the locked position, the threaded stud 340 of lock 338 presses ball 336 into contact with curved surface 350 of sleeve 334 so that ball 336 does not move relative to sleeve 334 when a caregiver attempts to move calf holder 246 relative to arm 244. In the unlocked position, the threaded stud 340 is in a position where the ball 336 is permitted to move relative to sleeve 334 and thus a caregiver may move calf holder 246 relative to arm 244. In alternative embodiments, the sleeve 334 includes a conical-shaped surface which the ball 336 abuts when the lock 338 is in the locked position.

As shown in FIG. 14, the central portion 266 of arm 244 is shaped to permit the calf holder 246 and arm 244 to be tucked in a nested relation, or positioned below, foot support 22, 24 when calf support 226, 228 is not needed and also permit the dish 328 to be positioned to receive a patient's calf when the calf support 226, 228 is needed. The central portion 266 of arm 244 includes spaced-apart first and second surfaces 352, 354 and spaced-apart third and fourth surfaces 356, 358 that each extend between the first and second surfaces 352, 354. Each of the surfaces 352, 354, 356, 358 are curved between the first and second ends 262, 264 of arm 244. The first and second surfaces 352, 354 are parallel and are curved so that the first surface 352 includes a radius that is larger than a radius of the second surface 354. The third and fourth surfaces 356, 358 are parallel and are curved to provide access to detent 252.

Figure 18:
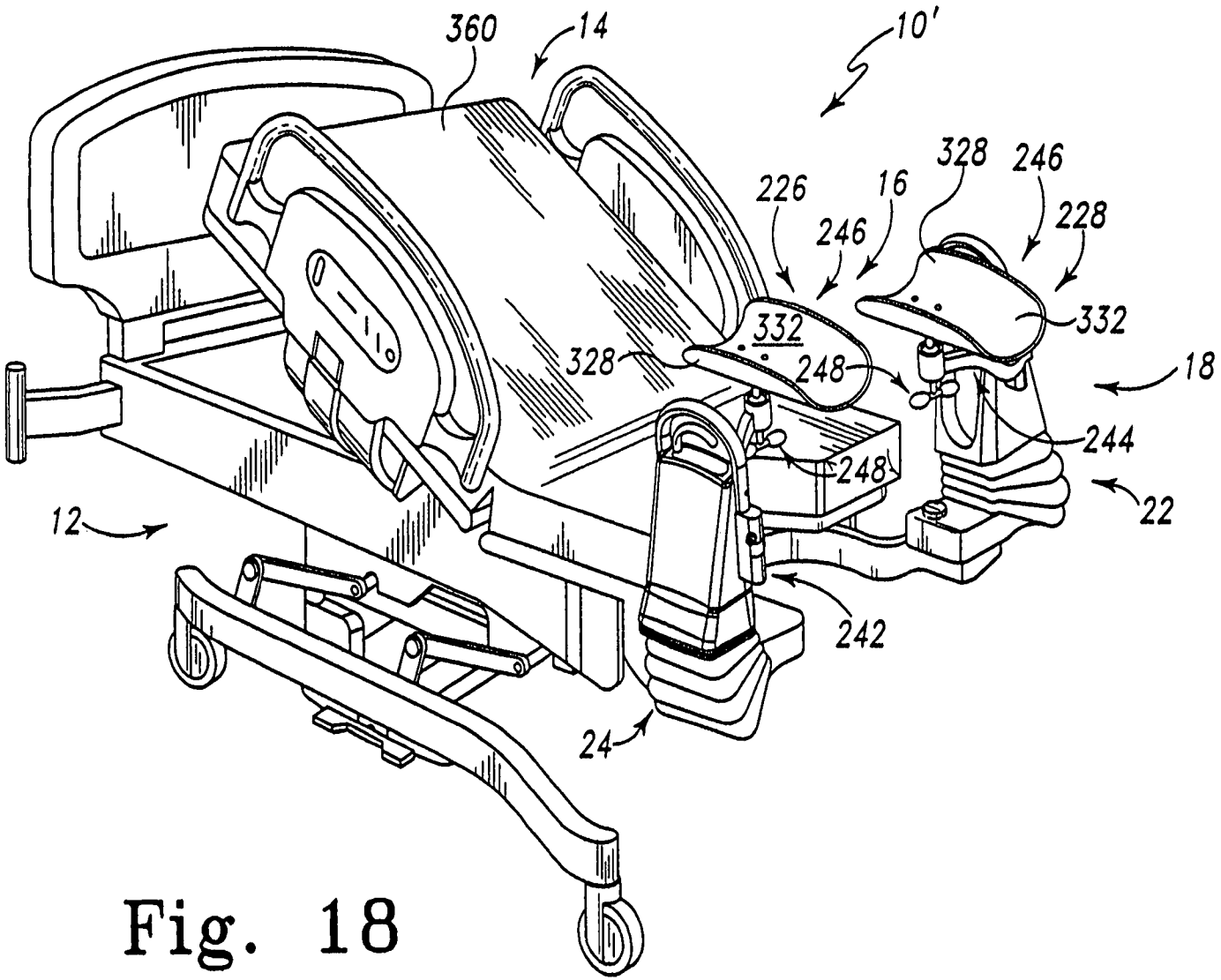
FIG. 18 is a perspective view similar to FIG. 13 showing the calf supports in their use position.

The calf supports 226, 228 are movable from a storage position under or below foot section 20 and foot supports 22, 24, respectively, as shown in FIG. 11, to a substantially upwardly facing use position as shown in FIG. 18. More particularly, in the storage position the calf support surface 332 is positioned in a nesting arrangement with its respective foot support 22, 24, as illustrated in phantom in FIG. 14, while in the use position the calf support surface 332 faces upwardly away from the foot support 22, 24 for receiving a patient's calf. To place the calf supports 226, 228 in the use position, the foot section 20 is removed, as shown in FIG. 12, and the foot supports 22, 24 are rotated about vertical and horizontal axes 26, 32, as shown in FIG. 13. Next, foot support couplers 242 are used to permit arms 244 and calf holders 246 of calf supports 226, 228 to move about axis 280, as shown in FIG. 14, from the position shown in phantom lines to the position shown in solid lines. Then, as shown in FIG. 16, couplers 248 are used to permit calf holders 246 to be moved from the position shown in phantom lines to the position shown in solid lines. The position of calf holders 246 in their use position can be adjusted by (1) rotating foot supports 22, 24 about vertical axis 26, (2) rotating foot supports 22, 24 about horizontal axis 32, (3) rotating arm 244 about axis 280, and (4) adjusting coupler 248 that sets the position of calf holder 246 relative to arm 244. The position of foot supports 22, 24 shown in FIGS. 13 and 18 is the preferred position to place foot supports 22, 24 when the calf supports 226, 228 are in their use position. However, the position of the foot supports 22, 24 can be adjusted to adjust the position of the calf supports 226, 228 in their use position.

Figure 19:
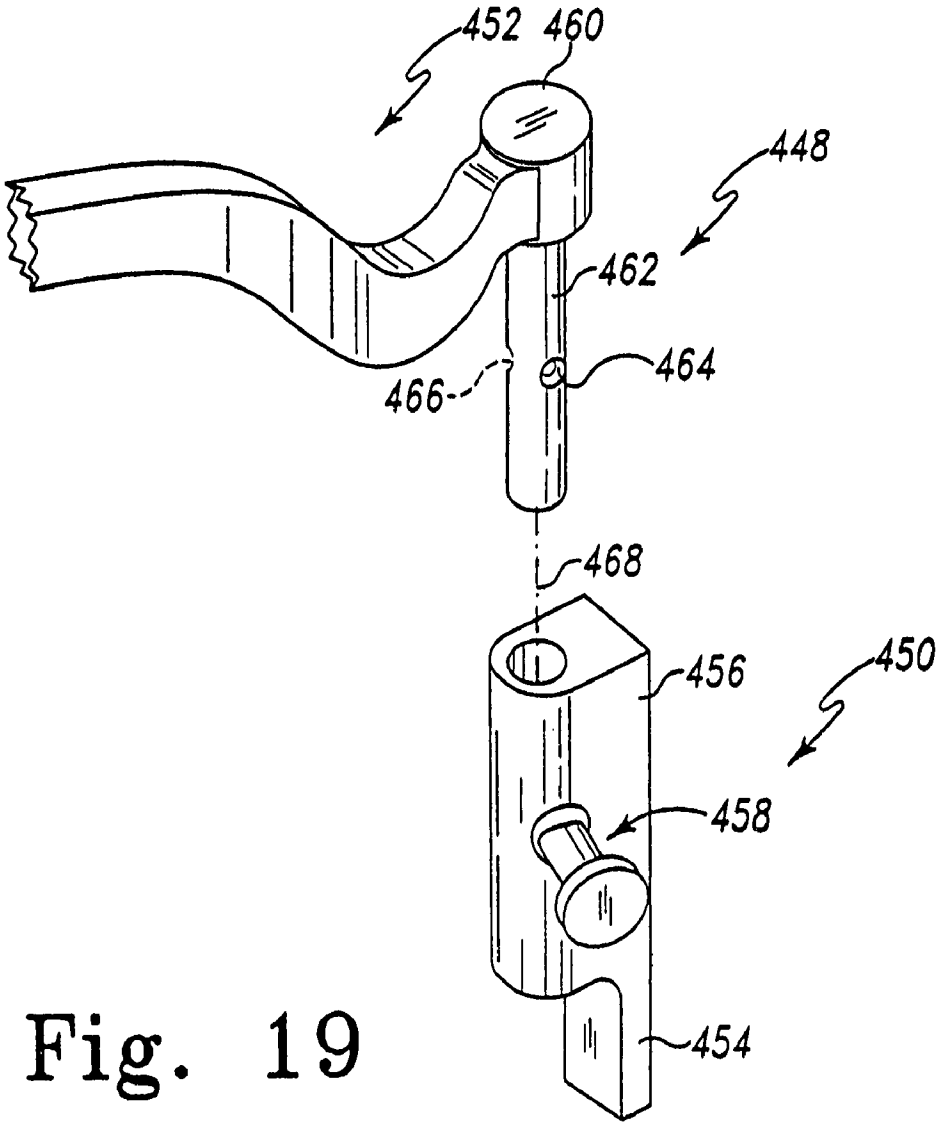
FIG. 19 is a perspective view, similar to FIG. 15, of an alternative foot support coupler and a portion of the arm of the calf support.

An alternative embodiment foot support coupler 450 and arm 452 is shown in FIG. 19. This foot support coupler 450 and arm 452 are part of an alternative embodiment calf support 448 that also includes a calf holder and coupler that are identical to the calf holder 246 and coupler 248 of calf supports 226, 228. The foot support coupler 450 is coupled to foot support 22, 24 and includes a body 454, a sleeve 456, and a detent 458 that is identical to detent 252 of calf supports 226, 228.

The arm 452 includes a head 460 and a rod 462 that is coupled to head 460 and positioned in sleeve 456 of foot support coupler 450. Except for head 460 and rod 462, all other portions of arm 452 are identical to arm 244 of calf supports 226, 228. The rod 462 includes first and second apertures 464, 466 that cooperate with detent 458 to lock the arm 452 relative to the foot support 22, 24 in a storage position and a use position. In alternative embodiments, the rod 462 may include additional apertures to provide additional positions wherein the arm 452 may be locked relative to the foot support 22, 24.

As discussed above for detent 252, a portion of detent 458 is spring-biased to extend in apertures 464, 466 to lock the arm 452 relative to the foot support 22, 24 in the storage and use positions, respectively. When the detent 458 is not aligned with apertures 464, 466 to lock the arm 452 relative to the foot support 22, 24, a caregiver may (1) rotate the arm 452 about an axis 468 relative to the foot support 22, 24 to move the arm 452 between the storage and use positions or (2) slide the rod 462 out of the sleeve 456 of foot support coupler 450 to remove the arm 452, calf holder 246, and coupler 248 from the foot support coupler 450 and foot support 22, 24.

Figure 20:
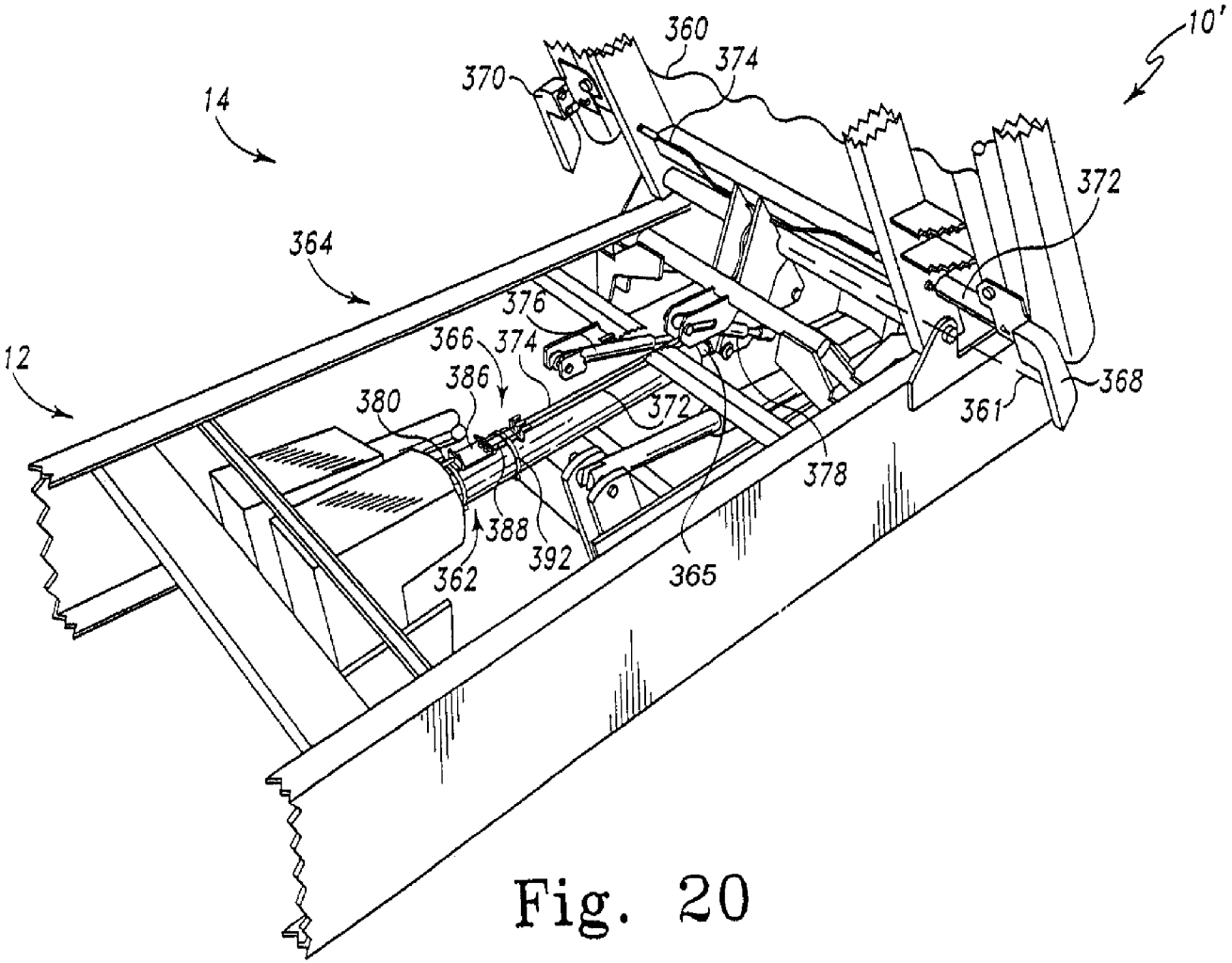
FIG. 20 is a perspective view, with portions cutaway, of the patient support shown in FIG. 11 showing the patient support including a frame, a support surface, and a release system.

The patient support 10' further includes a support surface 360, an actuator 362, and a release system or CPR release 364, as shown in FIG. 20. The support surface 360 extends over the head, seat, and foot portions 14, 16, 18 of the patient support 10' as shown in FIG. 1. In the illustrated embodiment, these head, seat, and foot portions 14, 16, 18 of support surface 360 are movable relative to each other.

Actuator 362 moves the head portion 14 of support surface 360 between a raised position wherein head portion 14 of support surface 360 is raised relative to seat portion 16 of support surface 360, as shown in FIGS. 11, 12, and 20, and a lowered position wherein the head and seat portions 14, 16 of support surface 360 lie in substantially the same plane or the head portion 14 of support surface 360 is in a lower position relative to seat portion 16 of support surface 360. The actuator 362 is operated to move the head portion 14 of support surface 360 between its raised and lowered positions by controls (not shown) accessible to the patient and/or caregiver. The actuator 362 is coupled intermediate the head portions 14 of frame 12 and support surface 360 of the patient support 10'. The actuator 362 moves the head portion 14 of support surface 360 between its raised and lowered positions by rotating head portion 14 of support surface 360 about an axis 361 as shown in FIG. 20.

The head portion 14 of support surface 360 may be maintained in a raised position. When the actuator 362 maintains the head portion 14 of support surface 360 in a raised position, the actuator 362 maintains a force on head portion 14 of support surface 360. In the illustrated embodiment, the actuator is a Linak™ brand actuator, model no. LA3452H+1X15904X available from Linak of Louisville, Ky.

Figure 21:
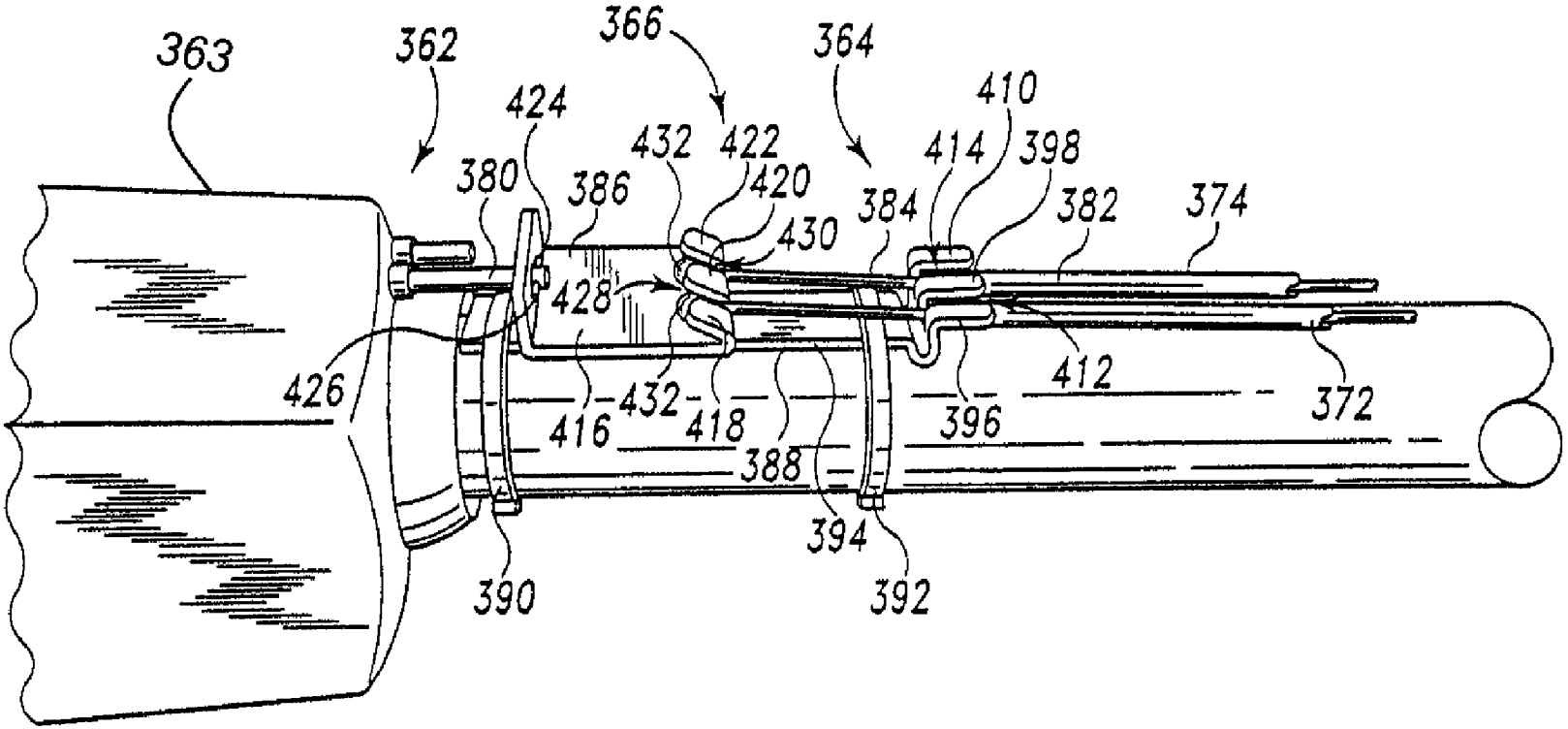
FIG. 21 is a perspective view of a portion of the release system of FIG. 20.

The release system 364 interacts with the actuator 362 to provide another mechanism (in addition to the controls discussed above) to lower the head portion 14 of support surface 360. As shown in FIG. 20, the release system 364 includes an actuator coupler 366, first and second handles 368, 370, first and second cables 372, 374 extending between the actuator coupler 366 and first and second handles 368, 370, respectively, and first and second springs 376, 378. As shown in FIG. 21, the actuator 362 includes an actuator body 363, a release switch 380, and an extensible rod 365 (shown in FIGS. 20 and 21). Actuator coupler 366 is coupled to this release switch 380. Extensible rod 365 is coupled to head portion 14. Actuation of switch 380 releases the force exerted by actuator 362 through rod 365 on head portion 14 of support surface 360 so that head portion 14 may move from its raised position to its lowered position.

The first and second handles 368, 370 are positioned on opposites sides of patient support 10 as shown in FIG. 20. The first cable 372 extends from the first handle 368 through the cable guide 388 to the actuator coupler 366 and the second cable 374 extends from the second handle 370 through the cable guide 388 to the actuator coupler 366. Each of cables 372, 374 includes a sheath 382 and a wire 384 that extends through sheath 382.

The actuator coupler 366 includes a release switch/cable coupler 386, a cable guide 388, and first and second cable guide couplers 390, 392, as shown in FIG. 21. Release switch/cable coupler 386 is supported on a portion of the cable guide 388 for movement relative to the actuator body 363 and the cable guide 388. The release switch/cable coupler 386 and cable guide 388 are separate parts that move relative to one another.

The cable guide 388 permits the wire 384 to pass through the cable guide 388 to the release switch/cable coupler 386 while not permitting the sheath 382 to move past the cable guide 388 toward switch/cable coupler 386. The cable guide 388 includes a body 394 and first, second, and third projections 396, 398, 410 coupled to body 394. The projections 396, 398, 410 define openings 412, 414 that are sized to receive wires 384 but not sheaths 382 of first and second cables 372, 374. Thus, wires 384 are permitted to pass through openings 412, 414 while the sheaths 382 are not permitted to pass through openings 412, 414.

The cable guide 388 is coupled to actuator 362 by first and second cable guide couplers 390, 392. In the illustrated embodiment, the cable guide couplers 390, 392 are plastic ties that wrap around the actuator 362 and body 394 of cable guide 388 as shown in FIG. 21.

The release switch/cable coupler 386 includes a body 416, first, second, and third projections 418, 420, 422 coupled to body 416, an aperture 424, and a coupler 426. The projections 418, 420, 422 define first and second openings 428, 430 through which the wire 384 of first and second cables 372, 374 extend. Each of the first and second cables 372, 374 further includes an enlarged end 432 coupled to the end of the wire 384 to secure the wire 384 to the actuator coupler 366. The enlarged end 432 of first cable 372 abuts and is positioned between body 416 and first and second projections 418, 420 to secure first cable 372 to actuator coupler 366 and, similarly, the enlarged end 432 of second cable 374 abuts and is positioned between body 416 and second and third projections 420, 422 to secure second cable 374 to actuator coupler 366. The release switch 380 extends through aperture 424 as shown in FIG. 21. The coupler 426 is coupled to release switch 380 and abuts body 416 to couple release switch 380 to switch/cable coupler 386 so that release switch 380 moves with switch/cable coupler 386.

Figure 22:
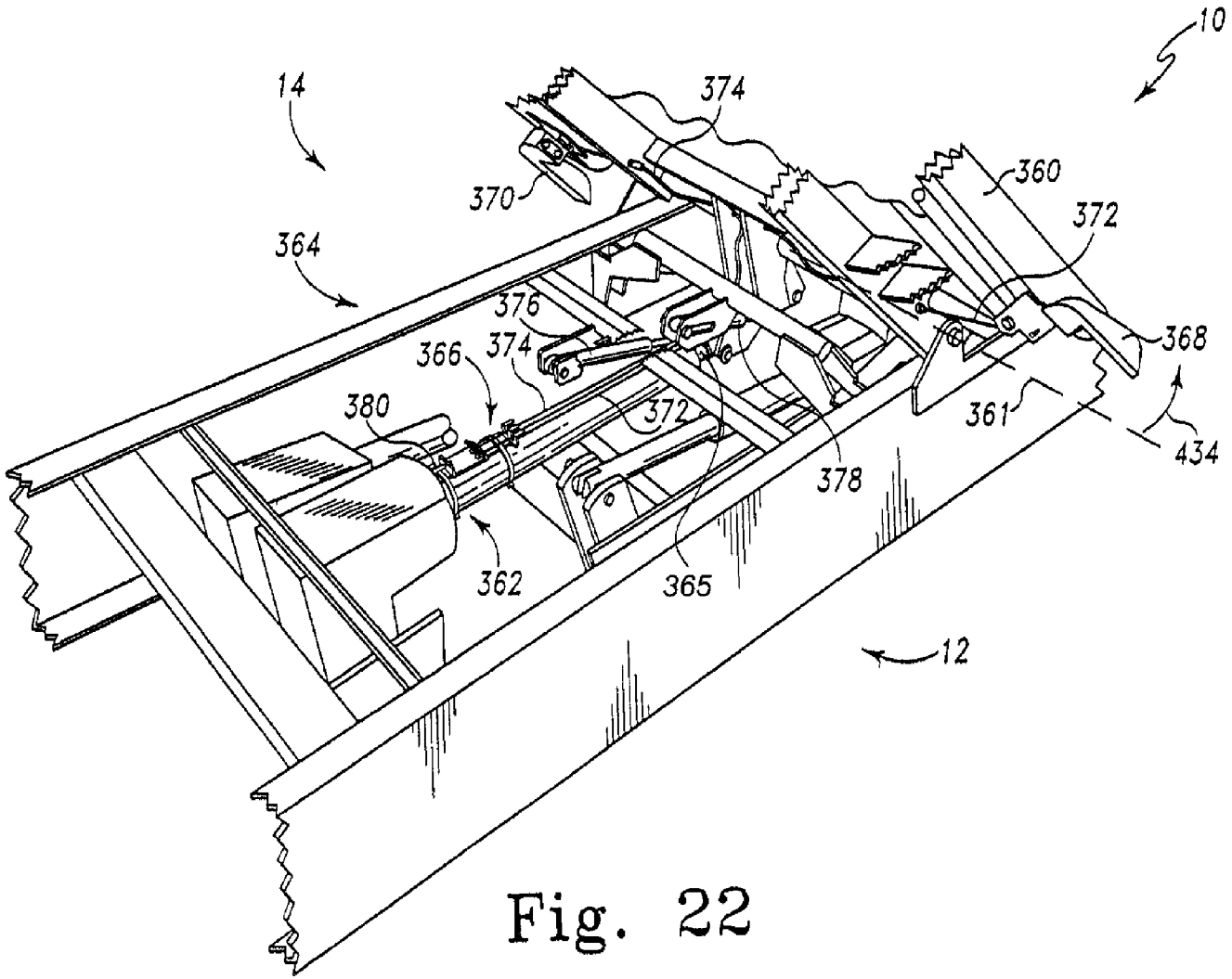
FIG. 22 is a perspective view, with portions cutaway, similar to FIG. 20, showing the release system being actuated to lower the head portion of the support surface.

When either of the handles 368, 370 are moved in direction 434 as illustrated in FIG. 22, one of the cables 372, 374 transfers this movement to switch/cable coupler 386 of actuator coupler 366 and release switch 380 of actuator 362. This movement actuates the release switch 380 so that the actuator 362 releases its force on head portion 14 of support surface 360 and head portion 14 of support surface 360 can move from its raised position to its lowered position. When the handle 368, 370 is released, the release switch 180 of actuator 362 is spring biased to return the cable 372, 374 and handle 368, 370 to their original positions as shown in FIG. 20.

The first and second springs 376, 378 assist in the movement of the head portion 14 of support surface 360 from its raised position to its lowered position. The first spring 376 is biased to dampen or slow movement of the head portion 14 of support surface 360 as it is moved from its raised position to its lowered position. The second spring 378 is biased to push the head portion 14 of support surface 360 downwardly from its raised position toward its lowered position. In the illustrated embodiment, the first and second springs 376, 378 are gas springs. In alternative embodiments, the springs 376, 378 may be any type of mechanism which provides the required biasing force, such as coil springs.

The release system 364 may be used in the event that a patient on support surface 360 of hospital bed 10 goes into cardiac arrest to rapidly lower the head portion 14 of patient support 360. In preferred embodiments, the release system 364 lowers the head portion 14 of patient support 360 quicker than the other controls discussed above.

Although the invention has been described in detail with reference to preferred embodiments, variations and modifications exist within the scope and spirit of the invention as described and defined in the following claims.

The invention claimed is:

1. A patient support comprising:

a frame, a support surface coupled to the frame and movable relative to the frame, an actuator having a variable length, the actuator including an actuator body and a release switch configured to release a force supported by the actuator, the actuator coupled to and positioned between the frame and the support surface to move at least a portion of the support surface between a raised position and a lowered position relative to the frame, and a release mechanism coupled to the actuator body including a cable guide mounted to the actuator body, a coupler coupled to the release switch and supported on the cable guide for movement relative to the actuator body and the cable guide, and a cable sized and arranged to extend through the cable guide, the cable coupled to the coupler.

2. The patient support of claim 1, wherein the coupler includes a body and first and second projections coupled to the body.

3. The patient support of claim 2, wherein the first and second projections define an opening sized to receive the cable.

4. The patient support of claim 3, wherein the cable includes a wire and a sheath surrounding the wire, and the cable guide separates the sheath from the first and second projections.

5. The patient support of claim 3, wherein the cable transfers motion to the coupler to move the coupler relative to the cable guide.

6. The patient support of claim 1, wherein the cable guide includes first and second projections defining an opening sized to receive the cable.

7. The patient support of claim 1, wherein the actuator includes a rod coupled to the support surface.

8. The patient support of claim 7, wherein the rod is configured for extensible movement to move the portion of the support surface between the raised position and the lowered position.

9. The patient support of claim 8, wherein the release switch is operable to release a force exerted on the portion of the support surface by the actuator rod so that the portion of the support surface is moved from the raised position to the lowered position.

10. The patient support of claim 8, wherein the portion of the support surface is configured to support an upper body of a user.

11. An actuator release mechanism for a patient support, the release mechanism comprising:

an actuator having a variable length, the actuator including an actuator body and a release switch configured to release a force supported by the actuator, a cable guide mounted to the actuator body, and a coupler coupled to the release switch and supported on the cable guide for movement relative to the actuator body and the cable guide, and a cable sized and arranged to extend through the cable guide, the cable coupled to the coupler.

12. The actuator release mechanism of claim 11, wherein the coupler includes a body.

13. The actuator release mechanism of claim 12, wherein the coupler includes and first and second projections coupled to the body, and the first and second projections define an opening sized to receive the cable.

14. The actuator release mechanism of claim 11, wherein the cable includes a wire and a sheath surrounding the wire.

15. The actuator release mechanism of claim 14, wherein the cable guide includes a body and first and second projections and the cable guide separates the sheath from the coupler.

16. The actuator release mechanism of claim 14, wherein the cable transfers motion to the coupler to move the coupler relative to the cable guide.

17. The actuator release mechanism of claim 11, wherein the actuator includes and extensible rod and the release switch is operable to release a force exerted by the actuator so that the rod of the actuator moves between a first position and a second position.

18. The actuator release mechanism of claim 11, wherein the cable guide includes first and second projections defining an opening sized to receive the cable.

19. A patient support comprising:

a frame, a support surface coupled to the frame, an actuator having a variable length, the actuator including an actuator body, an extensible rod movable relative to the body, and a release switch movable relative to the body, the release switch configured to release a force supported by the actuator, the actuator coupled to and positioned between the frame and the support surface to move at least a portion of the support surface between a raised position and a lowered position, and a release mechanism coupled to the actuator body including a cable guide mounted to the actuator body, a coupler coupled to the release switch and supported on the cable guide for movement relative to the actuator body and the cable guide in a first direction along the common axis so that the release switch moves away from the actuator body and arranged for movement in a second direction, opposite to the first direction, along the common axis so that the release switch moves toward the actuator body, and a cable sized and arranged to extend through the cable guide, the cable coupled to the coupler.

20. The patient support of claim 19, wherein the coupler includes a body.

21. The patient support of claim 20, wherein the coupler includes and first and second projections coupled to the body, and the first and second projections define an opening sized to receive the cable.

22. The patient support of claim 19, wherein the release switch is operable to release a force exerted on the portion of the support surface by the actuator so that the portion of the support surface is moved from the raised position to the lowered position.

23. The patient support of claim 22, wherein the portion of the support surface is configured to support an upper body of a user.

* * * * *